US010903582B2

(12) United States Patent
Peng et al.

(10) Patent No.: US 10,903,582 B2
(45) Date of Patent: Jan. 26, 2021

(54) ANTENNA ARRAY AND COMMUNICATIONS DEVICE

(71) Applicant: HUAWEI TECHNOLOGIES CO., LTD., Guangdong (CN)

(72) Inventors: Jie Peng, Xi'an (CN); Xiaoqiang Yang, Xi'an (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/537,320

(22) Filed: Aug. 9, 2019

(65) Prior Publication Data

US 2019/0363449 A1 Nov. 28, 2019

Related U.S. Application Data

(63) Continuation of application No. PCT/CN2017/073246, filed on Feb. 10, 2017.

(51) Int. Cl.

*H01Q 21/00* (2006.01)
*H01Q 21/29* (2006.01)
*H01Q 5/55* (2015.01)

(52) U.S. Cl.

CPC ..... *H01Q 21/005* (2013.01); *H01Q 5/55* (2015.01); *H01Q 21/0068* (2013.01); *H01Q 21/0075* (2013.01); *H01Q 21/293* (2013.01)

(58) Field of Classification Search

CPC .... H01Q 21/0068; H01Q 5/55; H01Q 21/293; H01Q 21/0075; H01Q 21/005

See application file for complete search history.

(56) References Cited

U.S. PATENT DOCUMENTS 3,185,981 A * 5/1965 Bath ..... G01S 13/586 342/100
3,599,216 A * 8/1971 Paine ..... H01Q 21/24 343/771

(Continued)

FOREIGN PATENT DOCUMENTS

CN 201112554 Y 9/2008
CN 100466380 C 3/2009

(Continued)

OTHER PUBLICATIONS

Meng Mingxia et al, Design of Dual Polarized Shaped Beam Waveguide Slot Array Antenna. Journal of Telemetry, Tracking and Command, vol. 35 No. 6, Nov. 2014, 5 pages.

*Primary Examiner* — Graham P Smith
*Assistant Examiner* — Jae K Kim
(74) *Attorney, Agent, or Firm* — Womble Bond Dickinson (US) LLP

(57) ABSTRACT

An antenna array and a communications device are provided. The antenna array includes a feeding waveguide and a waveguide cover. A waveguide port is disposed on the feeding waveguide, and an array of radiation slots are arranged along the length of the waveguide cover. The slots are configured to transmit signals fed from the waveguide port, and are classified into a first subarray and a second subarray. At a center frequency of the antenna array, the difference between a beam angle of the first subarray and a required beam angle, and a difference between a beam angle of the second subarray and the required beam angle, is each less than a specified threshold. With a frequency change of the antenna array, the beam angle of the first subarray and the beam angle of the second subarray change in opposing directions. Therefore, when the first and second subarray (Continued)

beams are combined, the combined beam angle has reduced frequency dependence.

20 Claims, 17 Drawing Sheets

(56) References Cited

U.S. PATENT DOCUMENTS

| | | | | |
|---|---|---|---|---|
| 4,788,552 | A * | 11/1988 | Karlsson | H01Q 21/0043 343/767 |
| 5,189,433 | A * | 2/1993 | Stern | H01Q 3/24 343/770 |
| 5,955,998 | A * | 9/1999 | Roberts | H01Q 13/10 343/768 |
| 7,091,921 | B2 | 8/2006 | Ohno et al. | |
| 7,202,832 | B2 | 4/2007 | Wang | |
| 10,168,197 | B2 * | 1/2019 | Blodt | G01F 23/284 |
| 2004/0066346 | A1 * | 4/2004 | Huor | H01Q 21/064 343/770 |
| 2004/0090290 | A1 * | 5/2004 | Teshirogi | H01Q 21/0087 333/237 |
| 2005/0140556 | A1 * | 6/2005 | Ohno | H01Q 13/28 343/770 |
| 2005/0146476 | A1 * | 7/2005 | Wang | H01Q 1/3275 343/771 |
| 2010/0315178 | A1 * | 12/2010 | Udagawa | H01P 5/182 333/137 |
| 2012/0056776 | A1 | 3/2012 | Shijo et al. | |
| 2016/0028165 | A1 * | 1/2016 | Chen | H01Q 21/0043 343/771 |
| 2017/0179764 | A1 * | 6/2017 | Kurs | H01P 5/087 |
| 2017/0187121 | A1 * | 6/2017 | Kirino | H01Q 21/005 |
| 2017/0272145 | A1 * | 9/2017 | Lilja | H01Q 21/0056 |
| 2018/0301820 | A1 * | 10/2018 | Bregman | H01Q 13/10 |
| 2019/0260137 | A1 * | 8/2019 | Watanabe | H01Q 5/42 |
| 2019/0334247 | A1 * | 10/2019 | Tong | H01Q 13/085 |

FOREIGN PATENT DOCUMENTS

| | | | |
|---|---|---|---|
| CN | 201413867 | Y | 2/2010 |
| CN | 102394376 | A | 3/2012 |
| CN | 102931492 | A | 2/2013 |
| CN | 103384032 | A | 11/2013 |
| CN | 204011734 | U | 12/2014 |
| CN | 104538742 | A | 4/2015 |
| EP | 0159301 | A1 | 10/1985 |
| JP | 2011211298 | A | 10/2011 |

* cited by examiner

ANTENNA ARRAY AND COMMUNICATIONS DEVICE

CROSS-REFERENCE TO RELATED APPLICATIONS

This application is a continuation of International Application No. PCT/CN2017/073246, filed on Feb. 10, 2017, the disclosure of which is hereby incorporated by reference in its entirety.

TECHNICAL FIELD

This application relates to the field of antenna technologies, and in particular, to an antenna array and a communications device.

BACKGROUND

In current wireless communication, high-speed data services and access requirements for connecting all things are exploding. To meet a future service requirement, each equipment vendor spares no effort to analyze requirements for and study key technologies of a 5th generation (5G) mobile communications system. A millimeter-wave antenna array is a key technology in 5G research. At a millimeter-wave band, waveguide slot antennas are widely applied for a low feeder loss and high radiation efficiency of the waveguide slot antenna.

In an antenna for a base station in wireless communications, to ensure downlink signal coverage quality, a plurality of antenna elements are usually used to form an array in a vertical direction to generate a relatively high beam gain, and amplitude excitation and phase excitation of each array element are properly configured, so that there is a specific tilt angle between a beam and a direction of an array surface normal line (as shown in FIG. 1). A low-band base station antenna is usually in a form of symmetric elements, where an excitation amplitude and an excitation phase of an array element are controlled in a feeding network made of a microstrip or a coaxial cable, and it is relatively simple to implement beam tilt. However, for the waveguide slot antenna at the millimeter-wave band, inconsistent beam directions can be caused by the relatively large size of a waveguide in the feeding network.

To implement beam tilt for a waveguide slot antenna array, a serial feeding waveguide traveling wave array is used in one approaching the prior art. FIG. 1 is a perspective schematic structural view. The antenna array mainly includes a feeding waveguide 300 and a plurality of radiation units 301 obtained by disposing rectangular slots on a top surface of the waveguide. The feeding waveguide 300 is usually implemented in a form of a ridge waveguide to reduce a size. The radiation units 301 are arranged along the feeding waveguide at a specific spacing. A signal from a base station device enters the feeding waveguide from a waveguide port 302, and an electromagnetic wave is propagated towards a waveguide end 303 in the feeding waveguide. Because a conduction current on a waveguide wall is cut off at each slot, a part of energy is coupled at each slot in the feeding waveguide, and radiates to free space. A wave absorbing load for absorbing energy that is not radiated by the radiation unit is usually installed on the waveguide end 303. The electromagnetic wave is propagated in the feeding waveguide in a form of a traveling wave. Waveguide traveling wave arrays are widely applied for a simple structure of the waveguide traveling wave array. However, performance of a broadband communications system is severely affected due to a relatively serious dispersion problem of the waveguide traveling wave array.

Amplitude excitation and phase excitation of an array element depend on a feature of a required antenna radiation directivity pattern. In the waveguide traveling wave array, excitation amplitude of an array element is controlled by a distance t at which a slot deviates from a center line of the waveguide, and an excitation phase of the array element is controlled by a center-to-center spacing d between adjacent slots.

Regardless of amplitude weighting, if a beam direction angle of the directivity pattern is required to deviate from a direction of an array surface normal line by θ degrees, the center-to-center spacing d between the adjacent slots may be determined according to the following formula 1, where λ is a free space wavelength corresponding to an antenna operating frequency, and $\lambda_g$ is a wavelength that is of the feeding waveguide and that is corresponding to the antenna operating frequency.

$$\sin(\theta) = \frac{\lambda}{\lambda_g} - \frac{\lambda}{2d} \tag{1}$$

Waveguide traveling wave antenna arrays are widely applied for a simple structure of the antenna array. However, in the broadband communications system, the system performance is severely affected due to the dispersion problem of the waveguide traveling wave antenna array. FIG. 2 shows a typical directivity pattern curve of the waveguide traveling wave array. At frequencies 27 GHz, 28 GHz, and 29 GHz, there are directivity pattern curves 310 to 312 and beam direction angles 6 degrees, 10 degrees, and 15 degrees. If the antenna array is used in a wireless base station communications system, beams at some frequencies do not point to an end user. Consequently, quality of a signal received by a terminal device is degraded.

The reason for this problem in the prior art can be found in formula 1. For a fixed element spacing d (greater than λ/2), at different frequencies λ, $\lambda_g$ decreases with the frequency, an absolute value of $\lambda_g$ is greater than λ, and a slope at which $\lambda_g$ changes with the frequency is also greater than λ. Consequently, at different frequencies, beams deviate from the array surface normal line by inconsistent direction angles θ. If $d<\lambda_g/2$, the beam direction angle decreases with the frequency, and if $d>\lambda_g/2$, the beam direction angle increases with the frequency. This is referred to as beam squint or beam dispersion, and the beam squint or the beam dispersion affects an antenna communication effect.

SUMMARY

This application provides an antenna array and a communications device, to improve an antenna array communication effect.

This application provides an antenna array, where the antenna array includes a feeding waveguide and a cover that covers the feeding waveguide, where a waveguide port is disposed on the feeding waveguide, a plurality of radiation slots that are arranged in a length direction of the feeding waveguide and that are configured to transmit signals fed in from the waveguide port are disposed on the cover, a plurality of radiation slots on one side of the waveguide port form a first subarray, and a plurality of radiation slots on the other side of the input waveguide form a second subarray, where at a center frequency of an operating frequency of the antenna array, a difference between a beam direction angle of the first subarray and a beam direction angle required by the antenna array and a difference between a beam direction angle of the second subarray and the beam direction angle required by the antenna array each are less than a specified threshold, and with a change of a frequency of the antenna array, a trend in which the beam direction angle of the first subarray changes with the frequency is contrary to a trend in which the beam direction angle of the second subarray changes with the frequency.

In one embodiment, the first subarray and the second subarray whose beam direction angles change with the frequency in contrary trends are disposed, and directions in which the beam direction angle of the first subarray and the beam direction angle of the second subarray deviate from the beam direction angle of the antenna array are opposite, but deviation angles are similar. Therefore, when the first subarray and the second subarray are combined, a beam direction difference at different frequencies can be better reduced, thereby improving an antenna array communication effect.

In one embodiment, the plurality of radiation slots are disposed along a center line of the feeding waveguide through staggering, a center-to-center spacing between adjacent radiation slots in the first subarray is s1, a center-to-center spacing between adjacent radiation slots in the second subarray is s2, s1 is greater than a half of a wavelength of the feeding waveguide, and s2 is less than a half of the wavelength of the feeding waveguide.

In one embodiment, the plurality of radiation slots in the first subarray are evenly spaced, and the plurality of radiation slots in the second subarray are evenly spaced.

In one embodiment, in the first subarray, a spacing between a center of a radiation slot close to the waveguide port and the waveguide port is t1, in the second subarray, a spacing between a center of a radiation slot close to the waveguide port and the waveguide port is t2, and both t1 and t2 are less than a half of the wavelength of the feeding waveguide.

In one embodiment, the feeding waveguide is a double-ridge waveguide, the waveguide port is located between two ridges of the double-ridge waveguide, and each of the two ridges is corresponding to one subarray.

In one embodiment, the plurality of radiation slots are disposed along a center line of the feeding waveguide through staggering, a center-to-center spacing between adjacent radiation slots in the first subarray and a center-to-center spacing between adjacent radiation slots in the second subarray each are s3, and s3 is greater than a half of a wavelength of the feeding waveguide, where the feeding waveguide is a double-ridge waveguide, the waveguide port is located between two ridges of the double-ridge waveguide, each of the two ridges is corresponding to one subarray, and a height of a ridge corresponding to the first subarray is greater than a height of a ridge corresponding to the second subarray.

In one embodiment, in the first subarray, a spacing between a center of a radiation slot close to the waveguide port and the waveguide port is t1, in the second subarray, a spacing between a center of a radiation slot close to the waveguide port and the waveguide port is t2, t1 is greater than t2, and both t1 and t2 are less than a half of the wavelength of the feeding waveguide.

In one embodiment, the plurality of radiation slots in the first subarray are located on a same side of a center line of the feeding waveguide, the plurality of radiation slots in the second subarray are disposed along the center line of the feeding waveguide through staggering, a center-to-center spacing between adjacent radiation slots in the first subarray and a center-to-center spacing between adjacent radiation slots in the second subarray each are s4, and s4 is less than a half of a wavelength of the feeding waveguide.

In one embodiment, in the first subarray, a spacing between a center of a radiation slot close to the waveguide port and the waveguide port is t1, in the second subarray, a spacing between a center of a radiation slot close to the waveguide port and the waveguide port is t2, t1 is greater than t2, and both t1 and t2 are less than a half of the wavelength of the feeding waveguide.

In one embodiment, s4 is a quarter of a waveguide wavelength of the feeding waveguide at the center frequency of the operating frequency band.

In one embodiment, for each radiation slot, a branch corresponding to the radiation slot is disposed on a sidewall of the feeding waveguide, a gap corresponding to the branch is disposed on the ridge of the feeding waveguide, the radiation slot is located on one side of the center line of the feeding waveguide, and the branch and the gap are located on the other side of the center line of the feeding waveguide.

This application further provides a communications device. The communications device includes a baseband precoder, a transceiver channel connected to the baseband precoder, and any antenna array that is described above and that is connected to the transceiver channel.

In some embodiments, the first subarray and the second subarray whose beam direction angles change with the frequency in contrary trends are disposed, and directions in which the beam direction angle of the first subarray and the beam direction angle of the second subarray deviate from the beam direction angle of the antenna array are opposite, but deviation angles are similar. Therefore, when the first subarray and the second subarray are combined, a beam direction difference at different frequencies can be better reduced, thereby improving an antenna array communication effect.

DESCRIPTION

In view of a problem of inconsistent beam directions of directivity patterns of an antenna array in a prior-art, this application provides a new antenna array. The antenna array includes a feeding waveguide and a cover that covers the feeding waveguide. A waveguide port is disposed on the feeding waveguide. A plurality of radiation slots that are arranged in a length direction of the feeding waveguide and that are configured to transmit signals fed in from the waveguide port are disposed on the cover. A plurality of radiation slots on one side of the waveguide port form a first subarray, and a plurality of radiation slots on the other side of the input waveguide form a second subarray.

At a center frequency of an operating frequency of the antenna array, a difference between a beam direction angle of the first subarray and a beam direction angle required by the antenna array and a difference between a beam direction angle of the second subarray and the beam direction angle required by the antenna array each are less than a specified threshold, and with a change of a frequency of the antenna array, a trend in which the beam direction angle of the first subarray changes with the frequency is contrary to a trend in which the beam direction angle of the second subarray changes with the frequency.

Figure 1:
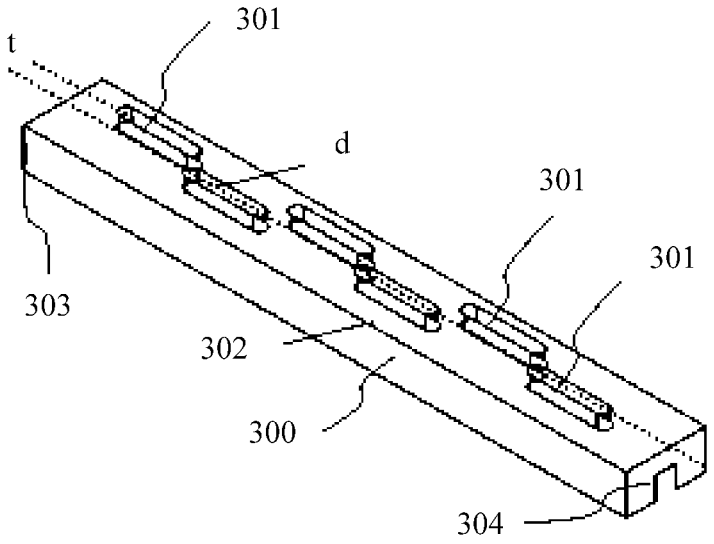
FIG. 1 (PRIOR ART)
FIG. 1 is a schematic structural diagram of a serial feeding waveguide slot antenna in the prior art.
Figure 2:
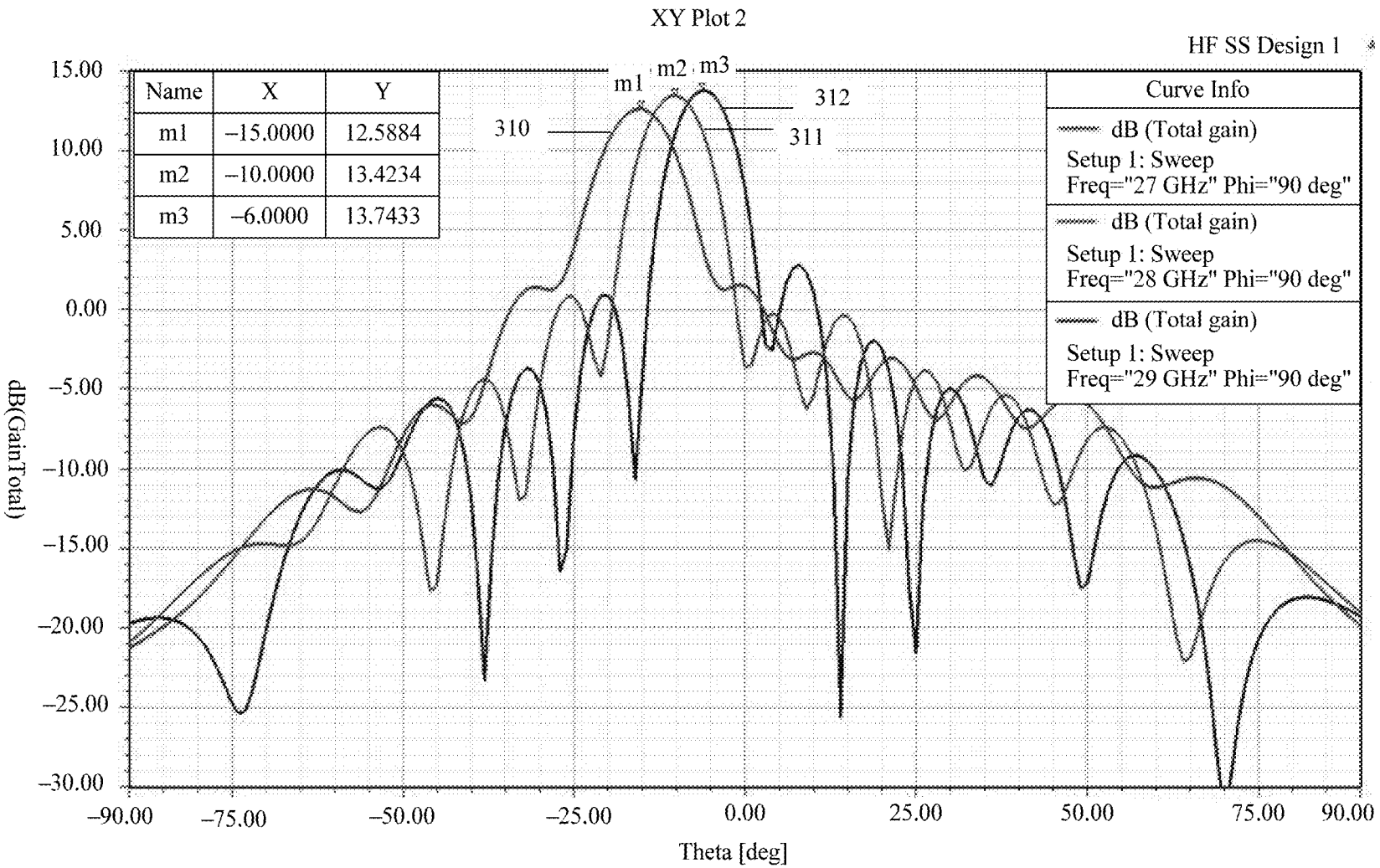
FIG. 2 shows directivity patterns of a serial feeding waveguide slot antenna at a low frequency, a center frequency, and a high frequency in the prior art.
Figure 3:
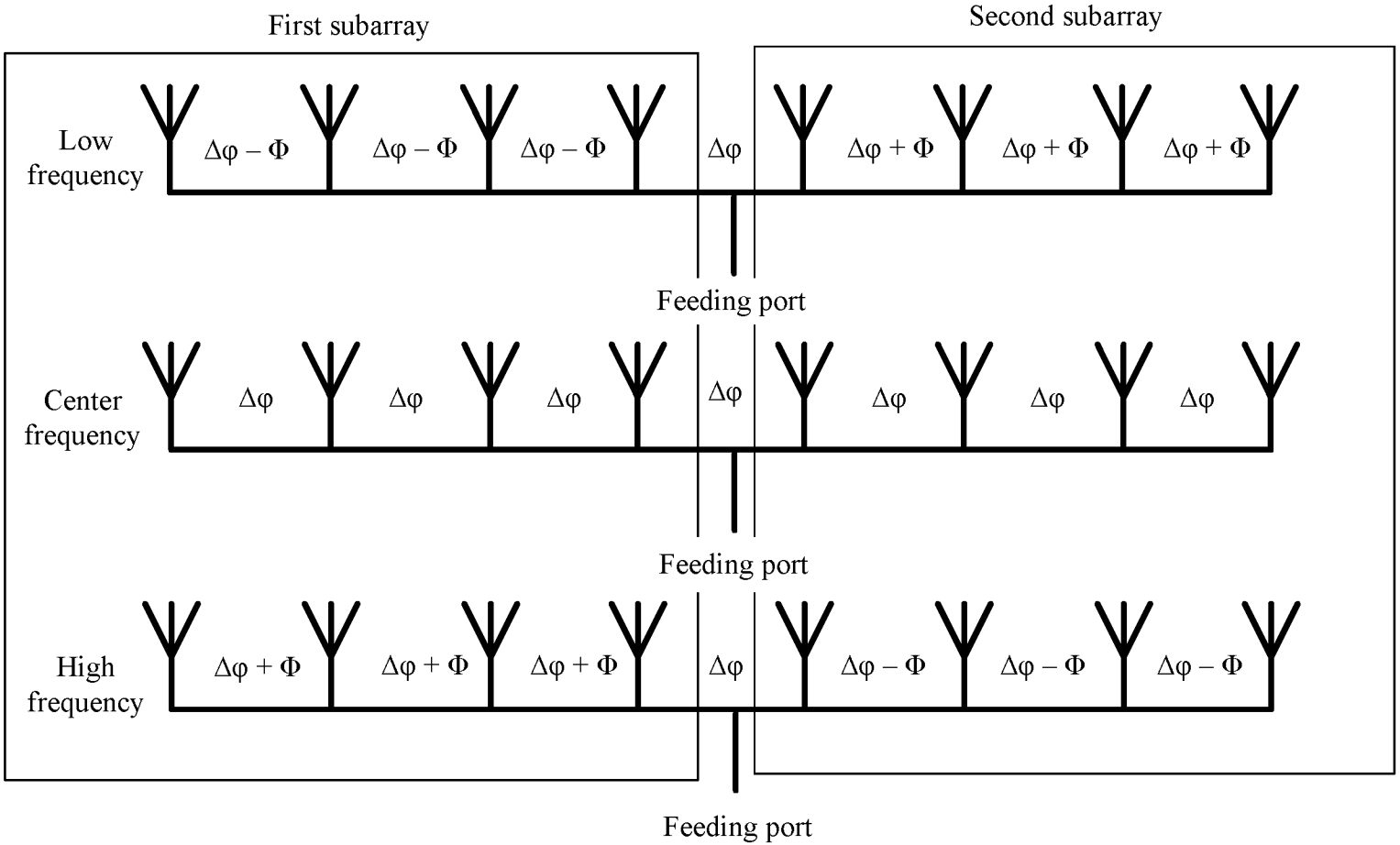
FIG. 3 is a topology diagram of an antenna array according to an embodiment of this application.

In the antenna array, a beam direction difference at different frequencies is better reduced by combining asymmetric central feeding subarrays. A specific principle is as follows: referring to a topology structure of an antenna array shown in FIG. 3, a feeding port of the array is disposed in the middle of the array, several antenna elements are arranged on each side of the port in a form of a conventional traveling wave array, and the entire array is divided into a first subarray and a second subarray by using the feeding port as a boundary. A location of each array element or a structure of a feeding waveguide is properly set, so that a phase difference between array elements (antennas) in each of the two subarrays approximately meets a specific relationship. A specific principle is as follows: at a center frequency F0 of an operating frequency band, an equivalent phase difference between adjacent array elements in the first subarray and an equivalent phase difference between adjacent array elements in the second subarray each are $\nabla\varphi$, where in a case of $\nabla\varphi$, a direction angle of a directivity pattern at the center frequency is a required angle $\theta$. At a low frequency FL of the operating frequency band, the equivalent phase difference between the array elements in the first subarray is $\nabla\varphi-\theta$, and the equivalent phase difference between the array elements in the second subarray is $\nabla\varphi+\theta$. At a high frequency FH of the operating frequency band, the equivalent phase difference between the array elements in the first subarray is $\nabla\varphi+\theta$, and the equivalent phase difference between the array elements in the second subarray is $\nabla\varphi-\theta$. For the first subarray, the equivalent phase difference between the array elements increases with the frequency, and a beam direction angle of a directivity pattern of the first subarray increases with the frequency. For the second subarray, the equivalent phase difference between the array elements decreases with the frequency, and a beam direction of a directivity pattern of the second subarray decreases with the frequency. Therefore, a beam direction angle of a directivity pattern of the entire array that is obtained through combination basically remains unchanged with the frequency because trends in which the beam direction angles of the two subarrays change with the frequency are contrary, thereby improving an antenna communication effect.

To facilitate understanding of the antenna array provided in the embodiments, the antenna array provided in this application is described below in detail with reference to specific accompanying drawings and embodiments.

Figure 4:
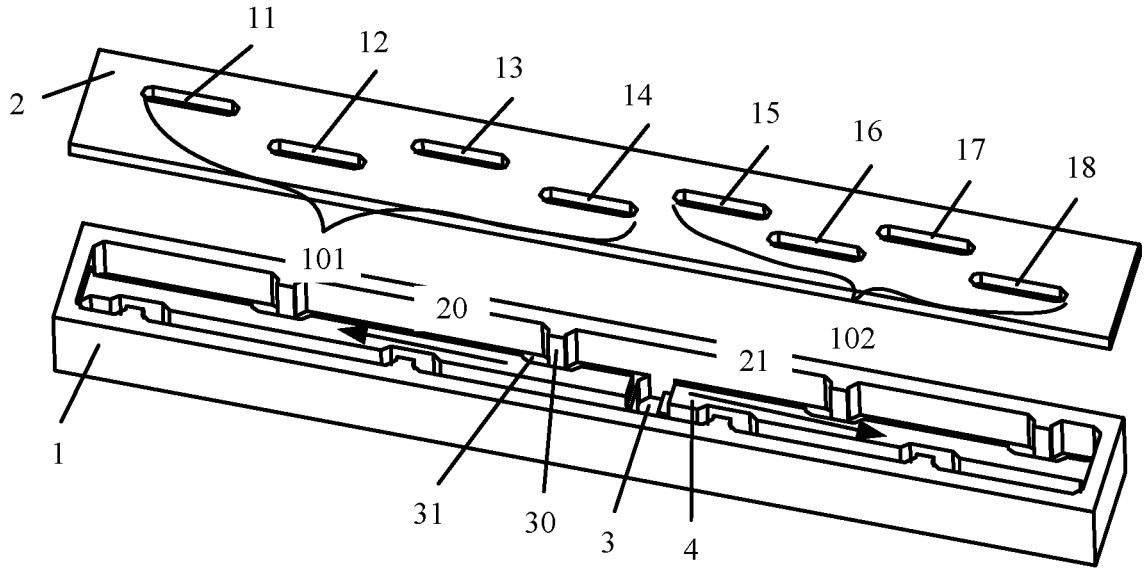
FIG. 4 is a schematic structural diagram of an antenna array according to an embodiment of this application.
Figure 5:
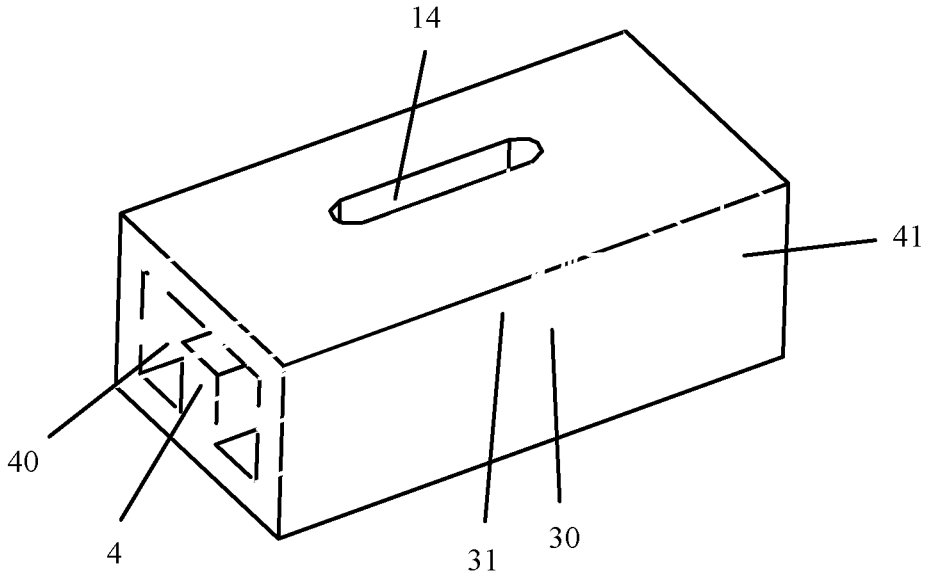
FIG. 5 is a schematic structural diagram of a radiation unit in the antenna array according to an embodiment of this application.
Figure 6:
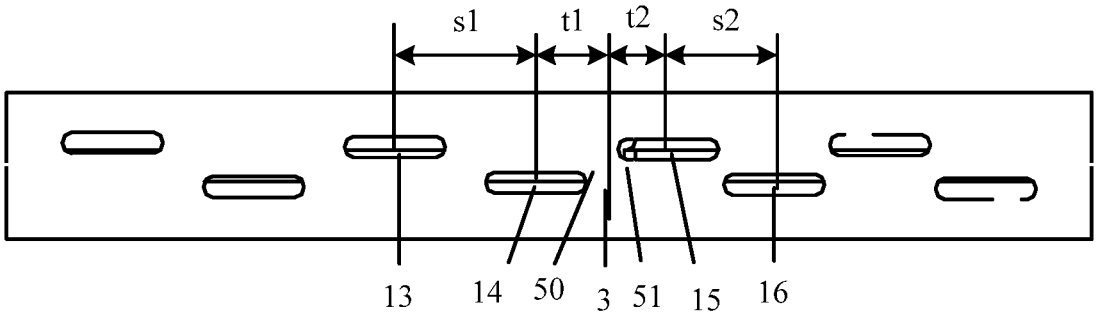
FIG. 6 is a top view of the antenna array according to an embodiment of this application.

FIG. 4 is a schematic structural diagram of an antenna array according to Embodiment 1 of this application, FIG. 5 is a schematic structural diagram of a radiation unit in the antenna array according to an embodiment of this application, and FIG. 6 is a top view of the antenna array according to this embodiment of this application.

As shown in FIG. 4, in this embodiment, the antenna array includes a feeding waveguide and a cover. Several radiation slots 11 to 18 are distributed on the cover along the feeding waveguide. The radiation slots may be classified into two groups that are distributed in directions 20 and 21. Signals are fed in from a waveguide port 3 located in the middle of the feeding waveguide. In the feeding waveguide, power is divided into two parts, the signals are propagated in the directions 20 and 21 in a form of a traveling wave, and the signals are radiated outwards from the radiation slots 11 to 18.

When the radiation slots 11 to 18 are specifically disposed, the radiation slots 11 to 14 form a first subarray, and the radiation slots 15 to 18 form a second subarray. When being specifically disposed, the plurality of radiation slots are disposed along a center line of the feeding waveguide through staggering. A center-to-center spacing between adjacent radiation slots in the first subarray is s1, and a center-to-center spacing between adjacent radiation slots in the second subarray is s2. The center-to-center spacing s1 between the adjacent radiation slots in the subarray 1 that are distributed in the direction 20 is greater than the center-to-center spacing s2 between the adjacent radiation slots distributed in the direction 21. In Embodiment 1 of this application, the antenna array is implemented by using two groups of radiation units with unequal spacings.

As shown in FIG. 4, in this embodiment, the feeding waveguide is in a form of a ridge waveguide. The ridge waveguide may be a standard metal waveguide or a dielectric waveguide. In a specific implementation, in consideration of a loss and an antenna array size, the dielectric waveguide is a metal ridge waveguide. The ridge waveguide can effectively reduce a width of the feeding waveguide, to reduce a grating lobe of a directivity pattern of a two-dimensional array obtained through combination. Specifically, the feeding waveguide is a double-ridge waveguide, and the waveguide port is disposed, as a feeding port, between two ridges 4 of the double-ridge waveguide. In addition, the two ridges 4 of the input waveguide are in a one-to-one correspondence with the first subarray and the second subarray.

In addition, for each radiation slot, a branch corresponding to the radiation slot is disposed on a sidewall of the feeding waveguide, and a gap corresponding to the branch is disposed on the ridge of the feeding waveguide. The radiation slot is located on one side of the center line of the feeding waveguide, and the branch and the gap are located on the other side of the center line of the feeding waveguide. In addition, a combination of a radiation slot, a branch, and a gap that are corresponding to each other forms a radiation unit. A direction in which a branch 30 and a gap 31 deviate from the center line 22 of the feeding waveguide is opposite to a direction in which a radiation slot deviates from the center line, in other words, the radiation slot and both the branch 30 and the gap 31 are located on two sides of the center line of the waveguide. A radio frequency signal is fed in from the port 30, and remaining energy obtained after radiation by a radiation unit is fed out from the port 31. A function of the branch 30 and the gap 31 is to cancel reflection of the radio frequency signal by the radiation slot, to ensure that a feeding port 40 is in an impedance matching state.

To facilitate understanding of the antenna array in this embodiment, a working principle of the antenna array is described below in detail.

A directivity pattern of the antenna array depends on excitation amplitude and an excitation phase of each radiation unit (impact of a location of the radiation unit is considered in the excitation phase). For the excitation amplitude, referring to FIG. 6, radio frequency signals are input from the waveguide port 3 in the middle of the feeding waveguide. In the feeding waveguide, power is divided into two parts, and the signals are propagated in the directions 20 and 21. The waveguide port 3 is located between the two ridges of the double-ridge waveguide. A power proportion between signals propagated in the two directions is controlled by a ridge 50 of the waveguide port 3 that is close to the propagation direction 20 and a ridge 51 that is close to the propagation direction 21. A larger ridge height d indicates larger allocated power. Heights of the ridge 50 and the ridge 51 may be changed to adjust distribution of amplitude of the first subarray 101 and the second subarray 102. Excitation amplitude of each radiation unit included in the first subarray 101 and the second subarray 102 may be adjusted by changing a distance at which the radiation slot deviates from the center line 22 of the waveguide. Specific amplitude excitation of each radiation unit depends on a required antenna directivity pattern. Actually, the excitation amplitude of the array element is less associated with a beam direction dispersion problem that is to be resolved in this application, and therefore is not described in detail herein.

For the excitation phase, because a center-to-center spacing t1 between the waveguide port 3 and the radiation slot 14, in the first subarray 101, that is close to the waveguide port 3 is greater than a center-to-center spacing t2 between the waveguide port 3 and the radiation slot 15, in the second subarray 102, that is close to the waveguide port 3, and both t1 and t2 are less than a half of a wavelength of the feeding waveguide, an excitation phase of a radiation unit in which the radiation slot 15 is located leads that of a radiation unit 14 in which the radiation slot 14 is located. The spacing s1 between the radiation slots arranged along the feeding waveguide in the direction 20 is greater than the spacing s2 between the radiation slots arranged along the feeding waveguide in the direction 21. Because s1 is greater than a half of the wavelength of the feeding waveguide, for radiation units 11 to 14 arranged in the direction 20, a phase difference greater than 180 degrees is introduced because a feeding path difference s1 is greater than a half of the wavelength of the feeding waveguide, and a phase difference of 180 degrees is additionally introduced because adjacent array elements are arranged along the center line of the waveguide through staggering. Therefore, an equivalent phase (a phase obtained by performing a modulo operation on an actual phase difference by using 360 degrees, where for example, if an actual phase difference is 380 degrees, an equivalent phase difference is 20 degrees) of each of the radiation units 11 to 14 leads that of a last radiation unit, in the radiation units 11 to 14, of the radiation unit (for example, an equivalent phase of the radiation slot 12 leads that of the radiation slot 11, and an equivalent phase of the radiation slot 13 leads that of the radiation slot 12). Because s2 is less than a half of the wavelength of the feeding waveguide, for radiation units 15 to 18 arranged in the direction 21, a phase difference less than 180 degrees is introduced because a feeding path difference s2 is less than a half of the wavelength of the feeding waveguide, and a phase difference of 180 degrees is additionally introduced because adjacent array elements are arranged along the center line of the waveguide through staggering. Therefore, an equivalent phase of each of the radiation units 15 to 18 also leads that of a last radiation unit, in the radiation units 15 to 18, of the radiation unit (for example, an equivalent phase of the radiation slot 16 leads that of the radiation slot 15, and an equivalent phase of the radiation slot 17 leads that of the radiation slot 16). As a whole, an equivalent excitation phase of a radiation unit corresponding to each of the radiation slots 11 to 18 leads that of a radiation unit corresponding to a last radiation slot, in the radiation slots 11 to 18, of the radiation slot. Therefore, a beam direction angle of a directivity pattern of the entire array deviates from an array surface normal line in a direction of 20 degrees. Values of t1, t2, s1, s2, and d depend on an excitation phase required by the radiation unit, and these values usually need to be determined by performing iteration for a plurality of times. For example, a beam tilt angle that needs to be designed is θ (a beam deviates from a direction of the normal line in the direction of 20 degrees). The ridge height d is first adjusted, so that a waveguide wavelength $\lambda_{g2}$ of the feeding waveguide at a center frequency of an operating frequency band approximates to 1.4 times of a free space wavelength λ, in other words, at the center frequency, $$\frac{\lambda_{g2}}{2} \approx 0.7 * \lambda,$$

and an initial phase difference between the radiation units is $$\nabla\varphi = 360 * \frac{\lambda_{g2}}{2\lambda} * \sin(\theta);$$

and the values of t1, t2, s1, and s2 are adjusted, so that an equivalent phase difference between adjacent units in the radiation units 11 to 18 at the center frequency approximates to ∇φ. ∇φ is a phase difference required for the beam direction angle θ at the element spacing $$\frac{\lambda_{g2}}{2},$$

and the spacing between the radiation units is unequal to $$\frac{\lambda_{g2}}{2}$$

after t1, t2, s1, and s2 are adjusted. Therefore, there is a specific deviation between the beam direction of the directivity pattern of the array and the angle θ. In this case, two phase differences $$\nabla\varphi 1 = 360 * \frac{s1}{\lambda} * \sin(\theta) \text{ and } \nabla\varphi 2 = 360 * \frac{s2}{\lambda} * \sin(\theta)$$

may be calculated by using s1 and s2, and then the value of s1 is adjusted again, so that the equivalent phase difference between the radiation slots 11 to 14 approximates to ∇φ1, and preferably, an error does not exceed 10% of the specified direction angle. The value of s2 is adjusted, so that the equivalent phase difference between the radiation slots 15 to 18 approximates to ∇φ2, and preferably, an error does not exceed 10% of the specified direction angle. In this way, both beam direction angles of directivity patterns of the first subarray 101 and 102 are θ. The values of t1 and t2 continue to be adjusted, so that a beam direction angle of a directivity pattern obtained by combining the two subarrays is θ.

Through the foregoing setting, the beam direction angle of the directivity pattern at the center frequency of the operating frequency band is θ. At a low frequency of the operating frequency band, a waveguide wavelength $\lambda_{g1}$ of the feeding waveguide is greater than the waveguide wavelength $\lambda_{g2}$ of the feeding waveguide at the center frequency. For the first subarray 101, because for the element spacing s1, $$s1 > \frac{\lambda_{g1}}{2} > \frac{\lambda_{g2}}{2},$$

an equivalent excitation phase difference between the radiation units in the first subarray 101 is less than ∇φ1, and a beam direction angle of a directivity pattern of the first subarray 101 is less than θ. For the second subarray 102, because for the element spacing s2, $$s2 < \frac{\lambda_{g2}}{2} < \frac{\lambda_{g1}}{2},$$

an equivalent excitation phase difference between the radiation units in the second subarray 102 is greater than ∇φ2, and a beam direction angle of a directivity pattern of the second subarray 102 is greater than θ. At the low frequency, because directions in which the beam direction angles of the directivity patterns of the two subarrays deviate from θ are opposite, a beam direction angle of a directivity pattern obtained by combining the two subarrays approximates to the angle θ because of partial cancellation. At a high frequency of the operating frequency band, a waveguide wavelength $\lambda_{g3}$ of the feeding waveguide is less than the waveguide wavelength $\lambda_{g2}$ of the feeding waveguide at the center frequency. For the first subarray 101, because for the element spacing s1, $$s1 > \frac{\lambda_{g2}}{2} > \frac{\lambda_{g3}}{2},$$

an equivalent excitation phase difference between the radiation units in the first subarray 101 is greater than ∇φ1, and a beam direction angle of a directivity pattern of the first subarray 101 is greater than θ. For the second subarray 102, because for the element spacing s2, $$s2 < \frac{\lambda_{g3}}{2} < \frac{\lambda_{g2}}{2},$$

an equivalent excitation phase difference between the radiation units in the second subarray 102 is less than ∇φ2, and a beam direction angle of a directivity pattern of the second subarray 102 is less than θ. Likewise, because directions in which the beam direction angles of the directivity patterns of the two subarrays deviate from θ are opposite, at the high frequency, a beam direction angle of a directivity pattern obtained by combining the two subarrays approximates to the angle θ because of partial cancellation.

Figure 7:
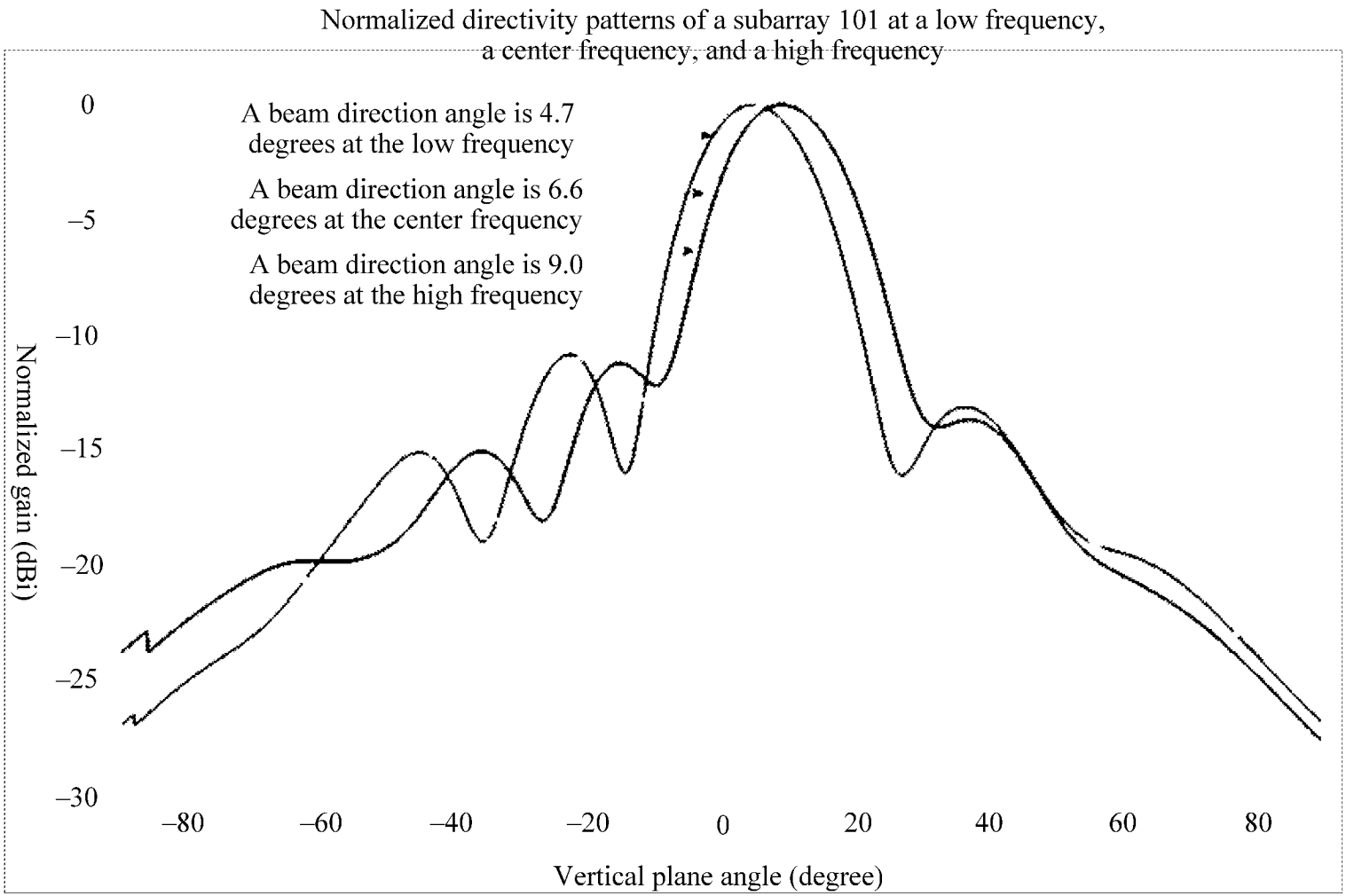
FIG. 7 shows directivity pattern curves of a first subarray 101 at a low frequency, a center frequency, and a high frequency according to an embodiment of this application.
Figure 8:
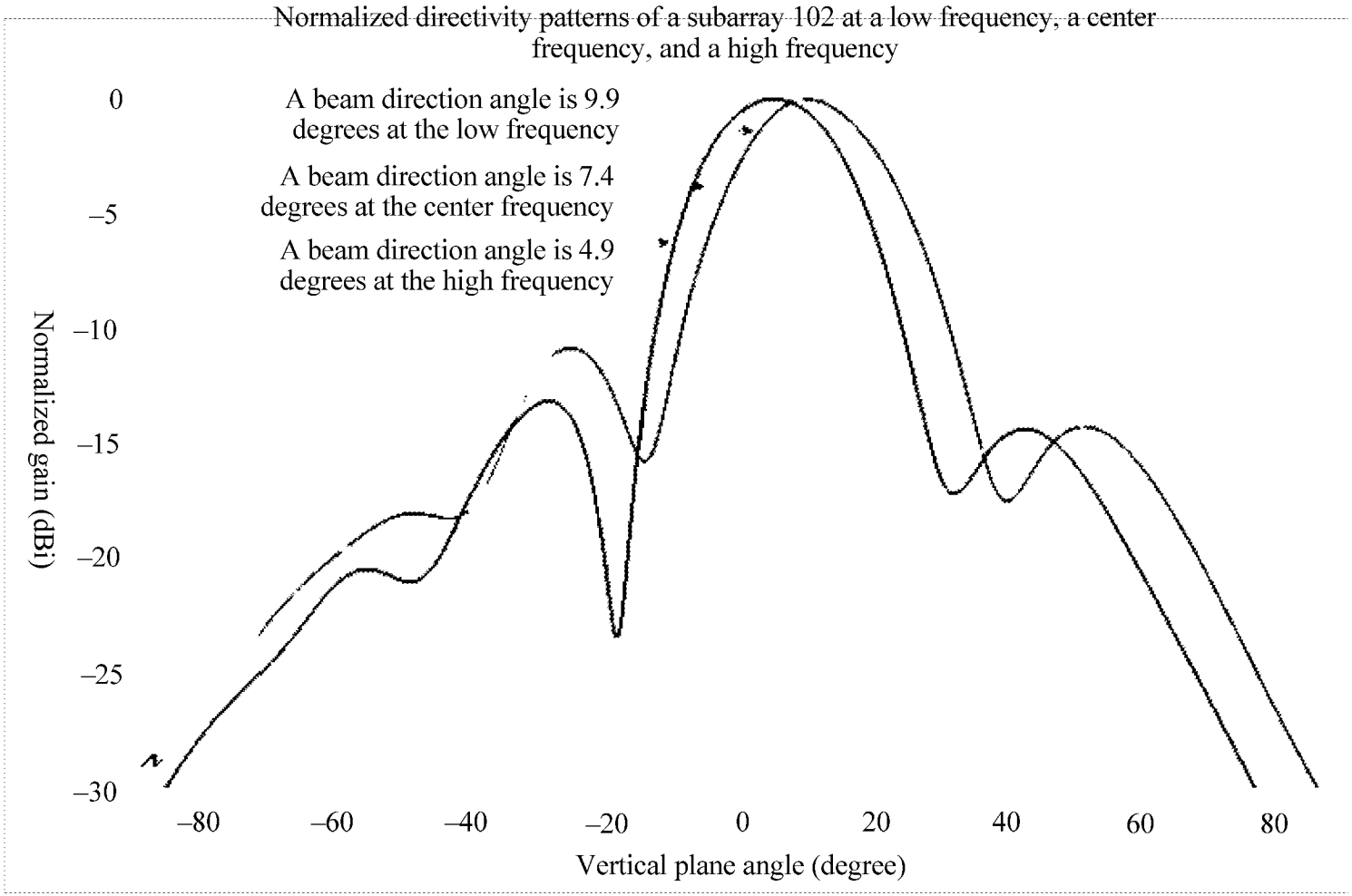
FIG. 8 shows directivity pattern curves of a second subarray 102 at a low frequency, a center frequency, and a high frequency according to an embodiment of this application.
Figure 9:
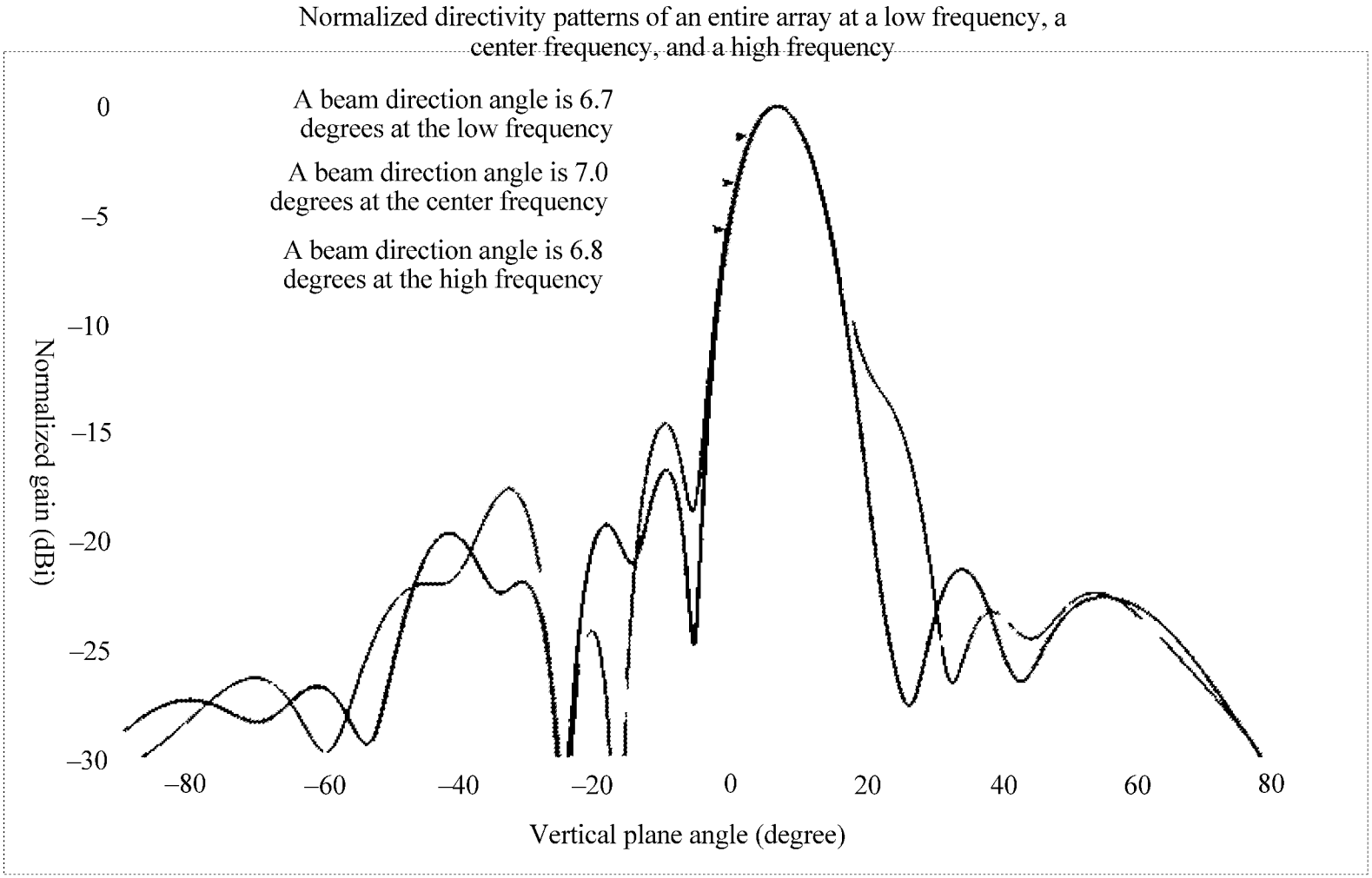
FIG. 9 shows directivity pattern curves of the entire antenna array at a low frequency, a center frequency, and a high frequency according to one embodiment of this application.

FIG. 7 and FIG. 8 respectively show directivity pattern curves at a low frequency, a center frequency, and a high frequency that are corresponding to the first subarray 101 and the second subarray 102 in the antenna array in Embodiment 1. Beam direction angles of directivity patterns of the first subarray 101 at the low frequency, the center frequency, and the high frequency are 4.7 degrees, 6.6 degrees, and 9.0 degrees, and beam direction angles of directivity patterns of the second subarray 102 at the low frequency, the center frequency, and the high frequency are 9.9 degrees, 7.4 degrees, and 4.9 degrees. Actually, it can be learned from the first subarray 101 and the second subarray 102 that there is a relatively large difference between the beam direction angles of the directivity patterns at the low frequency, the center frequency, and the high frequency regardless of whether a solution in which a spacing between elements in the first subarray 101 is greater than a half of the waveguide wavelength or a solution in which a spacing between elements in the second subarray 102 is less than a half of the waveguide wavelength is used. In addition, it can be learned that the beam direction angle of the directivity pattern of the first subarray 101 increases with the frequency, and the beam direction angle of the directivity pattern of the second subarray 102 decreases with the frequency. FIG. 9 shows directivity pattern curves of the entire array at a low frequency, a center frequency, and a high frequency. Beam direction angles of directivity patterns of the entire array at the low frequency, the center frequency, and the high frequency are 6.7 degrees, 7 degrees, and 6.7 degrees. It can be learned that in comparison with a difference between the beam direction angles of the first subarray 101 or the second subarray 102 at the low frequency, the center frequency, and the high frequency, there is a much smaller difference between the beam direction angles of the directivity patterns of the entire array. A reason for achieving the foregoing effect is that a trend in which the beam direction angle of the directivity pattern of the first subarray 101 changes with the frequency is contrary to a trend in which the beam direction angle of the directivity pattern of the second subarray 102 changes with the frequency, so that the directivity pattern obtained through combination basically remains unchanged because of partial cancellation.

It can be learned from the foregoing description that in comparison with the prior art, in Embodiment 1, the antenna waveguide port is disposed in the middle of the array, so that the array is divided into the two subarrays, and the location of the waveguide port and a spacing between radiation units in each of the two subarrays are adjusted, so that a beam of the directivity pattern at the center frequency of the operating frequency band points to a required angle. In addition, a trend in which a beam direction angle of a directivity pattern of one subarray changes with the frequency is contrary to a trend in which a beam direction angle of a directivity pattern of the other subarray changes with the frequency. In this way, the beam direction angle of the directivity pattern obtained by combining the two subarrays basically remains unchanged with the frequency, thereby resolving a prior-art problem that a beam direction of a directivity pattern changes with a frequency.

Figure 10:
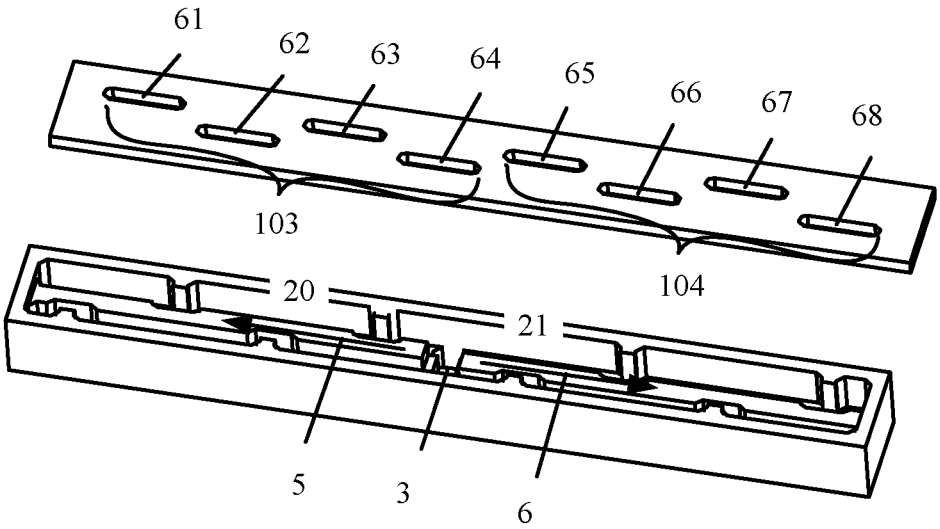
FIG. 10 is a schematic structural diagram of an antenna array according to an embodiment of this application.
Figure 11:
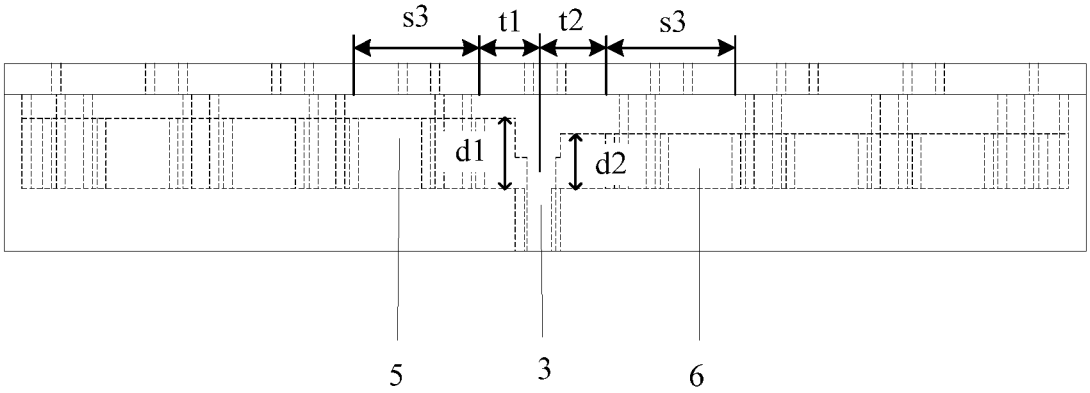
FIG. 11 is a top view of the antenna array according to an embodiment of this application.

FIG. 10 is a structural diagram of an antenna array according to an embodiment of this application, and FIG. 11 is a side view of the antenna array according to this embodiment of this application. A ridge waveguide is also used as a feeding waveguide provided in this embodiment for feeding, and a structure of a radiation unit is also consistent with those of the ridge waveguide and the radiation unit in the previous embodiment. A difference between the antenna array provided in this embodiment and the antenna array in the previous embodiment lies in that in this embodiment, a spacing between adjacent radiation slots in a first subarray 103 in a direction 20 is consistent with a spacing between adjacent radiation slots in a second subarray 104 in a direction 21. In other words, a center-to-center spacing between the adjacent radiation slots in the first subarray 103 and a center-to-center spacing between the adjacent radiation slots in the second subarray 104 each are s4, and s4 is greater than a half a wavelength of the feeding waveguide. In addition, in this embodiment, a height d1 of a ridge that is of the feeding waveguide and that is corresponding to the first subarray 103 is inconsistent with a height d2 of a ridge that is of the feeding waveguide and that is corresponding to the second subarray 104.

A working principle of the antenna array disclosed in Embodiment 2 of this application is as follows:

Excitation amplitude control of each radiation unit in this embodiment of this application is similar to that in the previous embodiment, and may be implemented by adjusting heights of two ridges of a waveguide port and a location at which each radiation slot deviates from a center line of the waveguide. For an excitation phase, because a center-to-center spacing t1 between the waveguide port 3 and a radiation slot 64, in the first subarray 103, that is close to the waveguide port 3 is greater than a center-to-center spacing t2 between the waveguide port 3 and a radiation slot 65, in the second subarray 104, that is close to the waveguide port 3, and both t1 and t2 are less than a half of the wavelength of the feeding waveguide, an equivalent excitation phase of a radiation unit 65 leads that of a radiation unit 64. The height of the ridge that is of the feeding waveguide and that is corresponding to the first subarray 103 is relatively large, a corresponding waveguide wavelength is relatively small, and a half of the wavelength of the waveguide is less than the spacing s3 between the adjacent elements in the first subarray 103. In this way, for radiation slots 61 to 64 arranged in the direction 20, a phase difference greater than 180 degrees is introduced because a feeding path difference s3 is greater than a half of the wavelength of the feeding waveguide, and a phase difference of 180 degrees is additionally introduced because adjacent elements are arranged along the center line of the waveguide through staggering. Therefore, an equivalent phase of each of radiation units 61 to 64 leads that of a last radiation unit, in the radiation units 61 to 64, of the radiation unit (for example, an equivalent phase of the radiation slot 62 leads that of the radiation slot 61, and an equivalent phase of the radiation slot 63 leads that of the radiation slot 62). The height of the ridge that is of the feeding waveguide and that is corresponding to the second subarray 104 is relatively small, a corresponding waveguide wavelength is relatively large, and a half of the wavelength of the waveguide is less than the spacing s3 between the adjacent elements in the second subarray 104. In this way, for radiation slots 65 to 68 arranged in the direction 21, a phase difference less than 180 degrees is introduced because a feeding path difference s3 is less than a half of the wavelength of the feeding waveguide, and a phase difference of 180 degrees is additionally introduced because adjacent elements are arranged along the center line of the waveguide through staggering. Therefore, an equivalent phase of each of radiation units 65 to 68 also leads that of a last radiation unit, in the radiation units 65 to 68, of the radiation unit (for example, an equivalent phase of the radiation slot 66 leads that of the radiation slot 65, and an equivalent phase of the radiation slot 67 leads that of the radiation slot 66). As a whole, an equivalent excitation phase of a radiation unit corresponding to each of the radiation slots 61 to 68 leads that of a radiation unit corresponding to a last radiation slot, in the radiation slots 61 to 68, of the radiation slot. Therefore, a beam direction angle of a directivity pattern of the entire array deviates from an array surface normal line in a direction of 20 degrees. Values of t1, t2, d1, d2, and s3 depend on an excitation phase required by the radiation unit. For example, a beam tilt angle that needs to be designed is θ (a beam deviates from a direction of the normal line in the direction of 20 degrees). The spacing s3 between the radiation units is first set to approximately 0.7 times of a wavelength at a center frequency of an operating frequency band, and a phase difference between the array elements that is required by the beam direction angle θ of an antenna directivity pattern is $$\nabla\varphi = 360 * \frac{s3}{\lambda} * \sin(\theta).$$

The ridge height d1 of the ridge 5 that is of the feeding network and that is corresponding to the first subarray 103 is adjusted, so that a waveguide wavelength that is of the feeding waveguide at the center frequency of the operating frequency band and that is corresponding to 103 is $\lambda_{g21}<2*s3$, an equivalent excitation phase difference between the radiation units in the first subarray 103 at the center frequency approximates to $\nabla\varphi$, and preferably, an error does not exceed 10% of the specified direction angle. The ridge height d2 of the ridge 6 that is of the feeding network and that is corresponding to the second subarray 104 is adjusted, so that a waveguide wavelength that is of the feeding waveguide at the center frequency of the operating frequency band and that is corresponding to 104 is $\lambda_{g22}>2*s3$, an equivalent excitation phase difference between the radiation units in the second subarray 104 at the center frequency approximates to $\nabla\varphi$, and preferably, an error does not exceed 10% of the specified direction angle. In this way, both beam direction angles of directivity patterns of the first subarray 103 and the second subarray 104 at the center frequency are $\theta$. The values of t1 and t2 continue to be adjusted, so that a beam direction angle of a directivity pattern obtained by combining the two subarrays is also $\theta$.

Through the foregoing setting, the beam direction angle of the directivity pattern at the center frequency of the operating frequency band is $\theta$. At a low frequency of the operating frequency band, for the first subarray 103, a waveguide wavelength $\lambda_{g11}$ of the feeding waveguide at the low frequency is greater than the waveguide wavelength $\lambda_{g21}$ of the feeding waveguide at the center frequency, for the element spacing s3, $$s3 > \frac{\lambda_{g11}}{2} > \frac{\lambda_{g21}}{2},$$

and an equivalent excitation phase difference between the radiation units in the first subarray 103 is less than $\nabla\varphi$. Therefore, a beam direction angle of a directivity pattern of the first subarray 103 is less than $\theta$. For the second subarray 104, a waveguide wavelength $\lambda_{g12}$ of the feeding waveguide at the low frequency is greater than the waveguide wavelength $\lambda_{g22}$ of the feeding waveguide at the center frequency, for the element spacing s3, $$s3 < \frac{\lambda_{g22}}{2} < \frac{\lambda_{g12}}{2},$$

and an equivalent excitation phase difference between the radiation units in the second subarray 104 is greater than $\nabla\varphi$. Therefore, a beam direction angle of a directivity pattern of the second subarray 104 is greater than $\theta$. At the low frequency, because directions in which the beam direction angles of the directivity patterns of the two subarrays deviate from $\theta$ are opposite, a beam direction angle of a directivity pattern obtained by combining the two subarrays approximates to the angle $\theta$ because of partial cancellation. At a high frequency of the operating frequency band, for the first subarray 103, a waveguide wavelength $\lambda_{g31}$ of the feeding waveguide at the low frequency is greater than the waveguide wavelength $\lambda_{g21}$ of the feeding waveguide at the center frequency, for the element spacing s3, $$s3 > \frac{\lambda_{g21}}{2} > \frac{\lambda_{g31}}{2},$$

and an equivalent excitation phase difference between the radiation units in the first subarray 103 is greater than $\nabla\varphi$. Therefore, a beam direction angle of a directivity pattern of the first subarray 103 is greater than $\theta$. For the second subarray 104, a waveguide wavelength $\lambda_{g32}$ of the feeding waveguide at the high frequency is less than the waveguide wavelength $\lambda_{g22}$ of the feeding waveguide at the center frequency, for the element spacing s3, $$s3 < \frac{\lambda_{g32}}{2} < \frac{\lambda_{g22}}{2},$$

and an equivalent excitation phase difference between the radiation units in the second subarray 104 is less than $\nabla\varphi$. Therefore, a beam direction angle of a directivity pattern of the second subarray 104 is less than $\theta$. Likewise, because directions in which the beam direction angles of the directivity patterns of the two subarrays deviate from $\theta$ are opposite, at the high frequency, a beam direction angle of a directivity pattern obtained by combining the two subarrays approximates to the angle $\theta$ because of partial cancellation.

Figure 12:
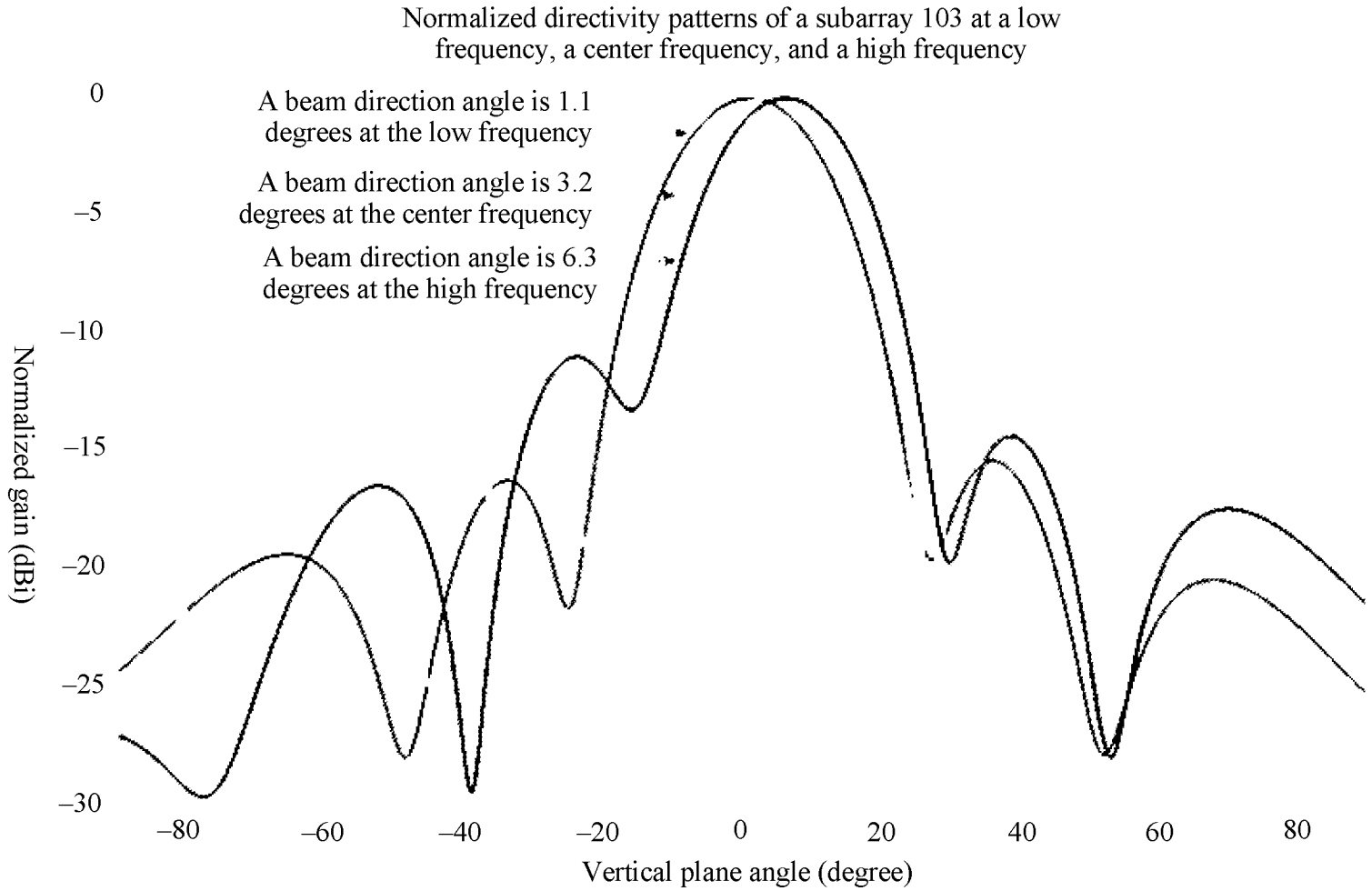
FIG. 12 shows directivity pattern curves of a first subarray 103 at a low frequency, a center frequency, and a high frequency according to an embodiment of this application.
Figure 13:
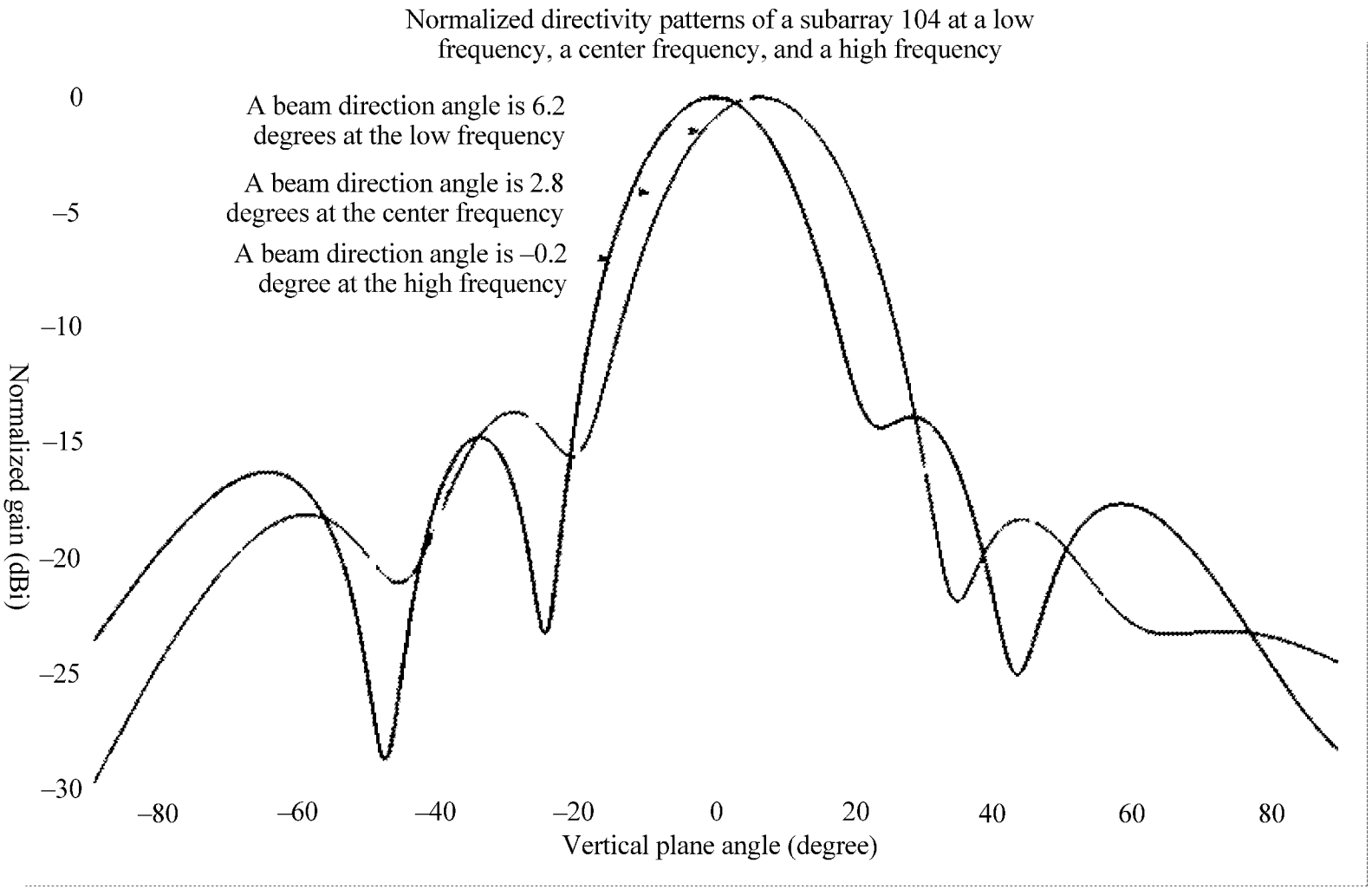
FIG. 13 shows directivity pattern curves of a second subarray 104 at a low frequency, a center frequency, and a high frequency according to an embodiment of this application.
Figure 14:
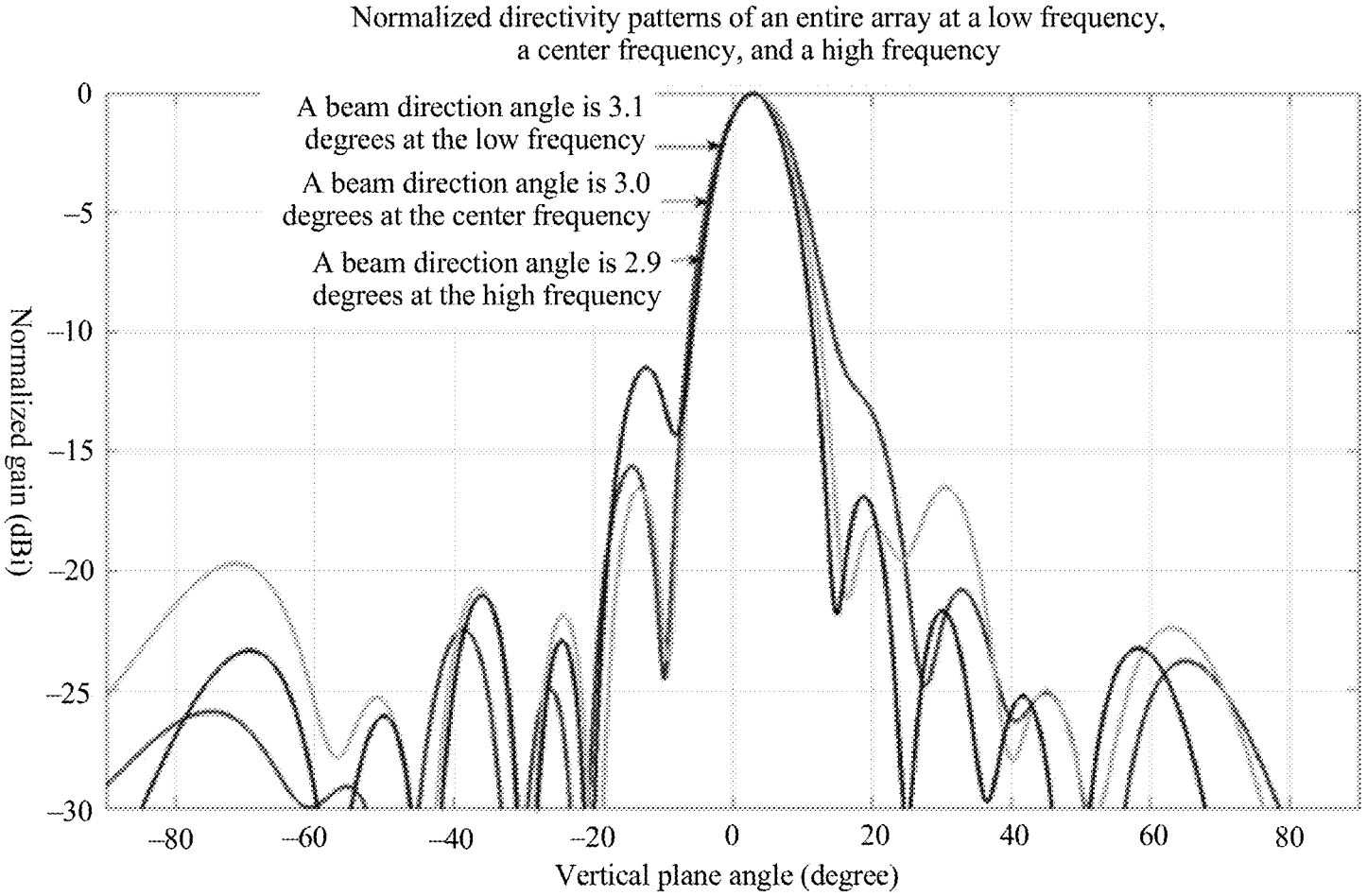
FIG. 14 shows directivity pattern curves of the entire antenna array at a low frequency, a center frequency, and a high frequency according to an embodiment of this application.

FIG. 12 and FIG. 13 respectively show directivity pattern curves at a low frequency, a center frequency, and a high frequency that are corresponding to the first subarray 103 and the second subarray 104 in the antenna array in Embodiment 2. Beam direction angles of directivity patterns of the first subarray 103 at the low frequency, the center frequency, and the high frequency are 1.1 degrees, 3.2 degrees, and 6.3 degrees, and beam direction angles of directivity patterns of the second subarray 104 at the low frequency, the center frequency, and the high frequency are 6.2 degrees, 2.8 degrees, and −0.2 degree. Therefore, there is a relatively large difference between beam direction angles of directivity patterns of each of the two subarrays at the low frequency, the center frequency, and the high frequency. In addition, it can be learned that the beam direction angle of the directivity pattern of the first subarray 103 increases with the frequency, and the beam direction angle of the directivity pattern of the second subarray 104 decreases with the frequency. FIG. 14 shows directivity pattern curves of the entire array at a low frequency, a center frequency, and a high frequency. Beam direction angles of directivity patterns of the entire array at the low frequency, the center frequency, and the high frequency are 3.1 degrees, 3.0 degrees, and 2.9 degrees. It can be learned that there is a much smaller difference between the beam direction angles of the directivity patterns of the entire array in comparison with those of the subarrays. A reason for achieving the foregoing effect is that a trend in which the beam direction angle of the directivity pattern of the first subarray 103 changes with the frequency is contrary to a trend in which the beam direction angle of the directivity pattern of the second subarray 104 changes with the frequency, so that the directivity pattern obtained through combination basically remains unchanged because of partial cancellation.

It can be seen from the foregoing description that in comparison with the prior art, in this embodiment of this application, the antenna waveguide port is disposed in the middle of the array, so that the array is divided into the two subarrays, and a location of the waveguide port and the heights of the ridges that are of the feeding waveguide and that are corresponding to the subarrays are adjusted, so that a beam of the directivity pattern at the center frequency of the operating frequency band points to a required angle. In addition, a trend in which a beam direction angle of a directivity pattern of one subarray changes with the frequency is contrary to a trend in which a beam direction angle of a directivity pattern of the other subarray changes with the frequency. In this way, the beam direction angle of the directivity pattern obtained by combining the two subarrays basically remains unchanged with the frequency, thereby resolving a prior-art problem that a beam direction of a directivity pattern changes with a frequency.

Figure 15:
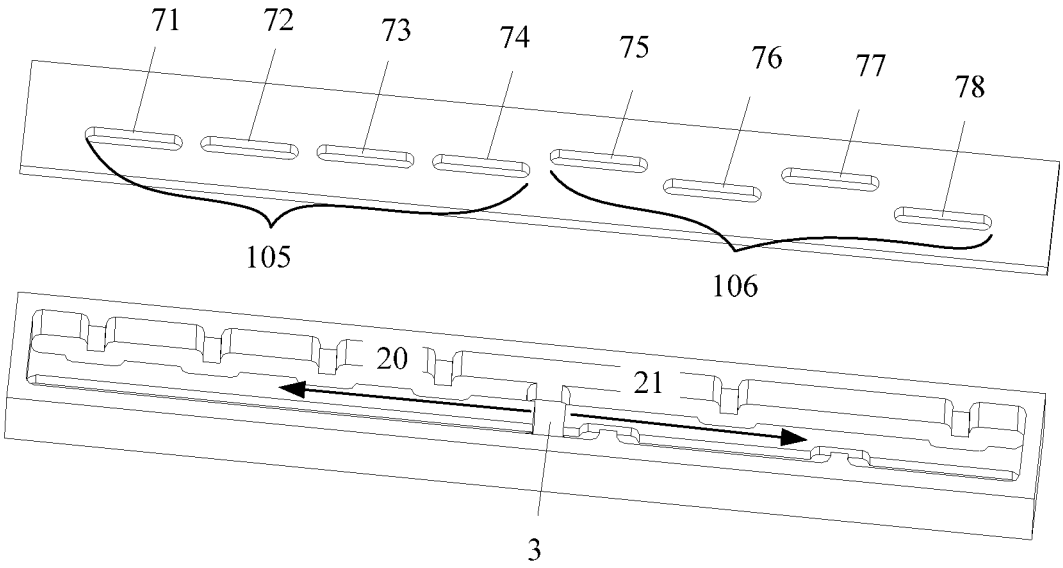
FIG. 15 is a schematic structural diagram of an antenna array according to an embodiment of this application.
Figure 16:
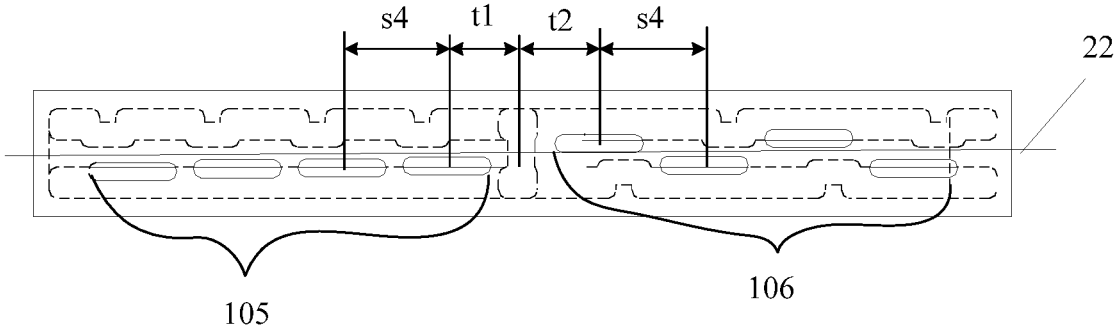
FIG. 16 is a top view of the antenna array according to an embodiment of this application.

FIG. 15 is a structural diagram of an antenna array according to one embodiment of this application, and FIG. 16 is a side view of the antenna array according to this embodiment of this application. In this embodiment, a ridge waveguide is also used for feeding, and a structure of a radiation unit is also consistent with that in the first embodiment. A difference lies in that in this embodiment, a spacing between adjacent elements in a first subarray 103 in a direction 20 is consistent with a spacing between adjacent radiation slots in a second subarray 104 in a direction 21, all elements in the first subarray 105 in the direction 20 deviate from a center line 22 of the waveguide on a same side, and elements in the second subarray 106 in the direction 21 deviate from the center line of the waveguide in alternate directions.

A working principle of the antenna array in this embodiment of this application is as follows:

Excitation amplitude control of each radiation unit is similar to that in the first embodiment, and may be implemented by adjusting heights of two ridges of a waveguide port and a location at which each radiation slot deviates from the center line of the waveguide. For an excitation phase, because a center-to-center spacing t1 between the waveguide port 3 and a radiation slot 74, in the first subarray 105, that is close to the waveguide port 3 is greater than a center-to-center spacing t2 between the waveguide port 3 and a radiation slot 75, in the second subarray 106, that is close to the waveguide port 3, and both t1 and t2 are less than a half of a wavelength of the feeding waveguide, an excitation phase of a radiation unit 75 leads that of a radiation unit 74. In this embodiment, preferably, a center-to-center spacing between the radiation slot 75 and the radiation slot 74 is equal to a center-to-center spacing between adjacent radiation slots in each of the two subarrays, and an excitation phase difference between the radiation slot 75 and the radiation slot 74 is 90 degrees at a center frequency. The radiation slots in the first subarray 105 deviate from the center line of the waveguide in a same direction, a spacing s4 between radiation units is less than a half of the wavelength of the feeding waveguide, and in this embodiment, preferably, s4 is a quarter of a wavelength of the waveguide at the center frequency. In this way, for radiation slots 71 to 74 arranged in the direction 20, a phase difference of 90 degrees is introduced because a feeding path difference s4 is equal to a quarter of the wavelength of the feeding waveguide, and an excitation phase of each of the radiation slots leads that of a last radiation slot, in the radiation slots, of the radiation slot by 90 degrees (for example, an excitation phase of the radiation slot 72 leads that of the radiation slot 71). The radiation slots in the second subarray 106 deviate from the center line of the waveguide in alternate directions. Because the radiation slots deviate from the center line of the waveguide in alternate directions, a phase difference of 180 degrees is additionally introduced for adjacent radiation units. In this way, a phase of a radiation unit corresponding to each of radiation slots 75 to 78 arranged in the direction 21 lags behind that of a radiation unit corresponding to a last radiation slot, in the radiation slots 75 to 78, of the radiation slot by 270 degrees, and this is equivalent to a case in which a phase of a radiation unit corresponding to each of the radiation slots 75 to 78 leads that of a radiation unit corresponding to a last radiation slot, in the radiation slots 75 to 78, of the radiation slot by 90 degrees (for example, a phase of the radiation slot 76 leads that of the radiation slot 75). As a whole, an equivalent excitation phase of a radiation unit corresponding to each of the radiation slots 71 to 78 leads that of a radiation unit corresponding to a last radiation slot, in the radiation slots 71 to 78, of the radiation slot by 90 degrees. Therefore, a beam direction angle of a directivity pattern of the entire array deviates from an array surface normal line in a direction of 20 degrees. Values of t1, t2, s4, and a ridge height depend on an excitation phase required by the radiation unit. For example, a beam tilt angle that needs to be designed is θ (a beam deviates from a direction of the normal line in the direction of 20 degrees). The spacing s4 between the radiation units is first set to $$\frac{\lambda}{4*\sin(\theta)},$$

so that an excitation phase difference between the radiation units is 90 degrees and the beam direction angle is θ. A height of a ridge of the feeding waveguide is adjusted, so that a waveguide wavelength of the feeding waveguide at a center frequency of an operating frequency band is $\lambda_{g2}=4*s4$. In this way, an equivalent excitation phase difference between radiation units in each of the first subarray 105 and the second subarray 106 is 90 degrees at the center frequency, and both beam direction angles of directivity patterns at the center frequency are θ. The values of t1 and t2 are then slightly adjusted, so that a beam direction angle of a directivity pattern obtained by combining the two subarrays is also θ.

Through the foregoing setting, the beam direction angle of the directivity pattern at the center frequency of the operating frequency band is θ. At a low frequency of the operating frequency band, for the first subarray 105, a waveguide wavelength $\lambda_{g1}$ of the feeding waveguide at the low frequency is greater than the waveguide wavelength $\lambda_{g2}$ of the feeding waveguide at the center frequency, for the element spacing s4, $$s4 = \frac{\lambda_{g2}}{4} < \frac{\lambda_{g1}}{4},$$

and an excitation phase difference between the radiation units in the first subarray 105 is less than 90 degrees. Therefore, a beam direction angle of a directivity pattern of the first subarray 105 is less than θ. For the second subarray 106, the waveguide wavelength of the feeding waveguide at the low frequency is greater than the waveguide wavelength $\lambda_{g2}$ of the feeding waveguide at the center frequency, for the element spacing s4, $$s4 = \frac{\lambda_{g2}}{4} < \frac{\lambda_{g1}}{4},$$

and an equivalent excitation phase difference between the radiation units in the second subarray 106 is greater than 90 degrees. Therefore, a beam direction angle of a directivity pattern of the second subarray 106 is greater than θ. At the low frequency, because directions in which the beam direction angles of the directivity patterns of the two subarrays deviate from θ are opposite, a beam direction angle of a directivity pattern obtained by combining the two subarrays approximates to the angle θ because of partial cancellation. At a high frequency of the operating frequency band, for the first subarray 105, a waveguide wavelength $\lambda_{g3}$ of the feeding waveguide at the high frequency is less than the waveguide wavelength $\lambda_{g2}$ of the feeding waveguide at the center frequency, for the element spacing s4, $$s4 = \frac{\lambda_{g2}}{4} > \frac{\lambda_{g3}}{4},$$

and an excitation phase difference between the radiation units in the first subarray 105 is greater than 90 degrees. Therefore, a beam direction angle of a directivity pattern of the first subarray 105 is greater than θ. For the second subarray 106, the waveguide wavelength $\lambda_{g3}$ of the feeding waveguide at the high frequency is less than the waveguide wavelength $\lambda_{g2}$ of the feeding waveguide at the center frequency, for the element spacing s4, $$s4 = \frac{\lambda_{g2}}{4} > \frac{\lambda_{g3}}{4},$$

and an equivalent excitation phase difference between the radiation units in the second subarray 106 is less than 90 degrees. Therefore, a beam direction angle of a directivity pattern of the second subarray 106 is less than θ. At the high frequency, because directions in which the beam direction angles of the directivity patterns of the two subarrays deviate from θ are opposite, a beam direction angle of a directivity pattern obtained by combining the two subarrays approximates to the angle θ because of partial cancellation.

Figure 17:
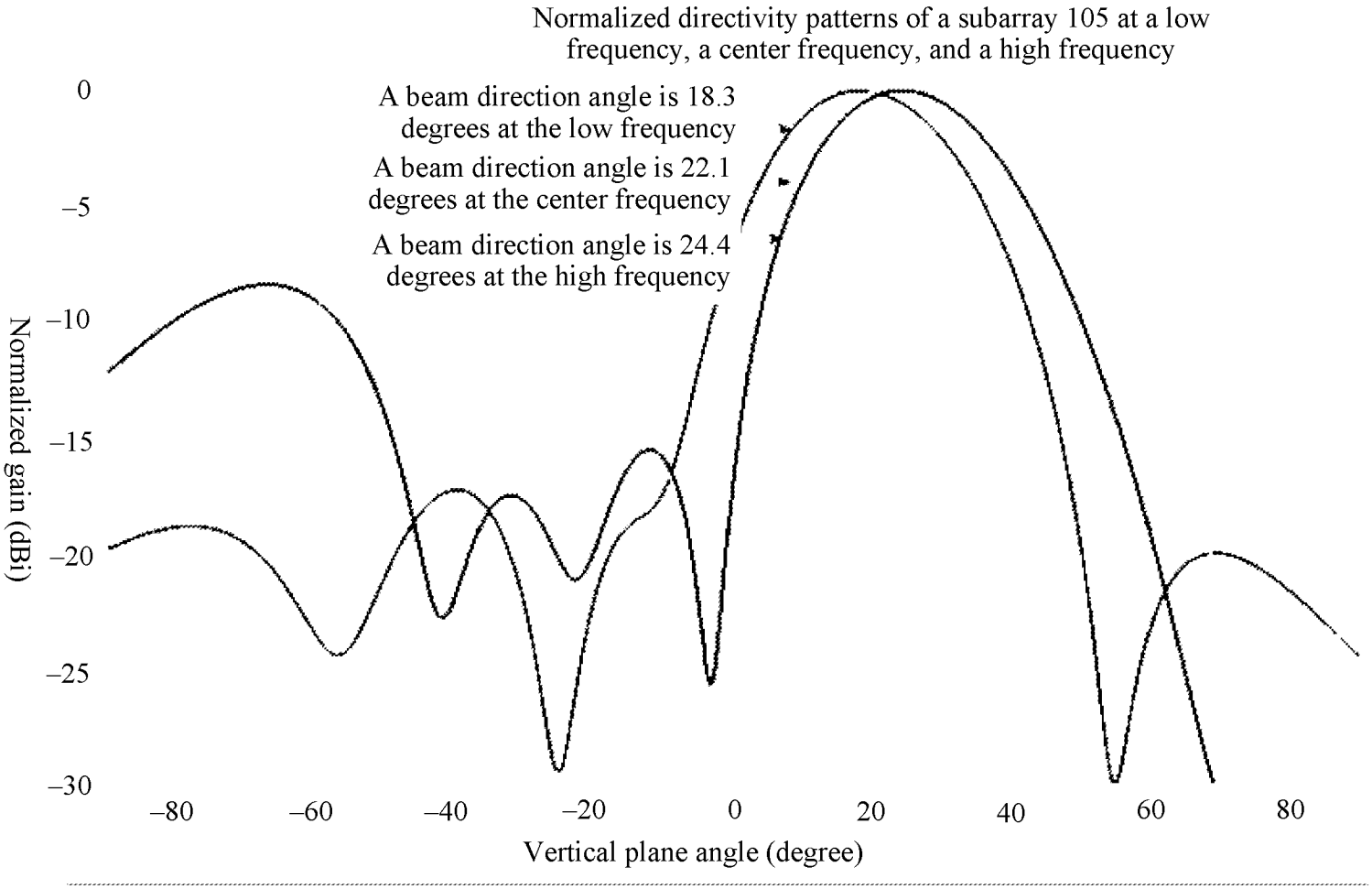
FIG. 17 shows directivity pattern curves of a first subarray 105 at a low frequency, a center frequency, and a high frequency according to an embodiment of this application.
Figure 18:
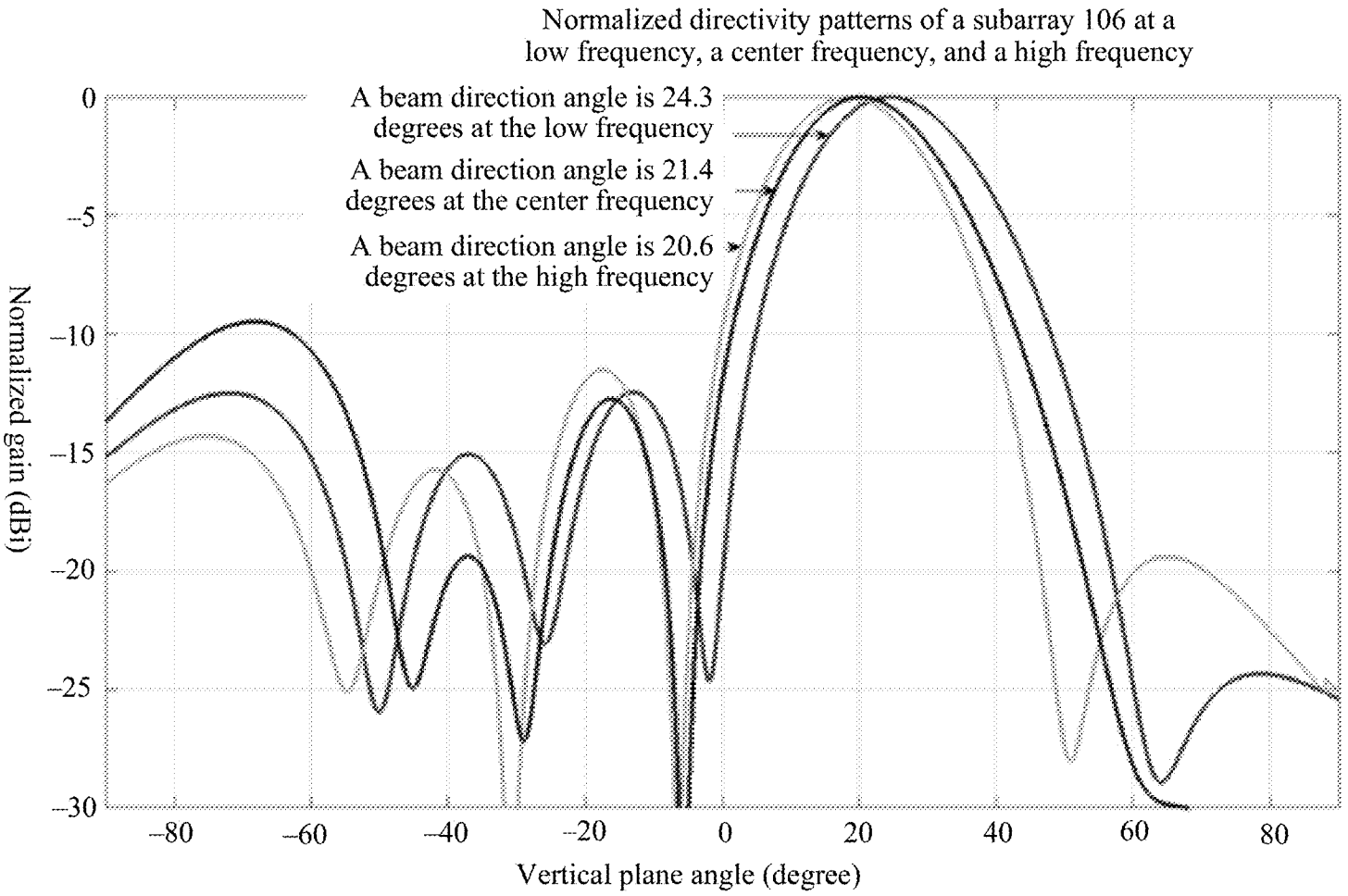
FIG. 18 shows directivity pattern curves of a second subarray 106 at a low frequency, a center frequency, and a high frequency according to an embodiment of this application.
Figure 19:
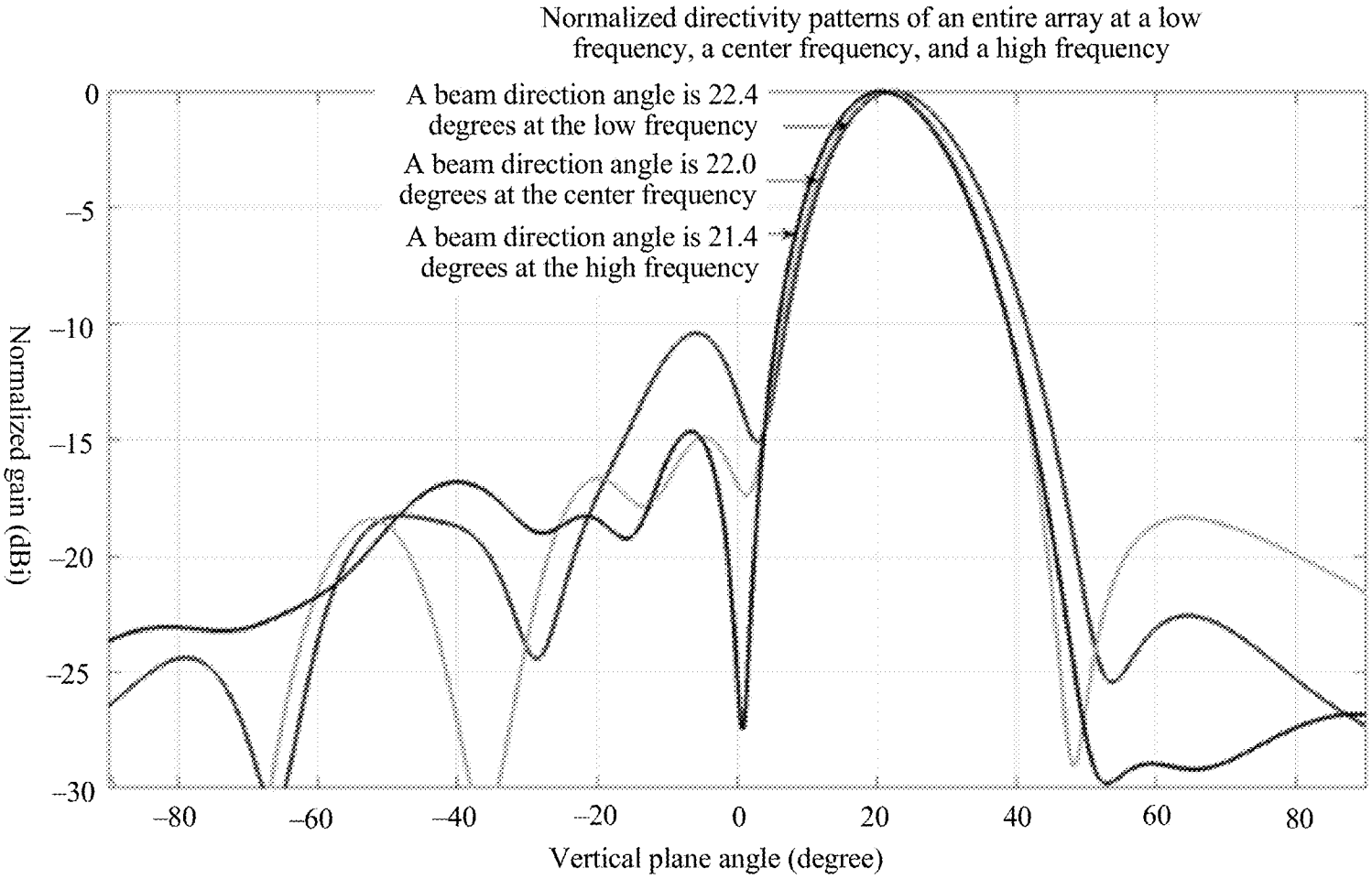
FIG. 19 shows directivity pattern curves of the entire antenna array at a low frequency, a center frequency, and a high frequency according to an embodiment of this application.

FIG. 17 and FIG. 18 respectively show directivity pattern curves at a low frequency, a center frequency, and a high frequency that are corresponding to the first subarray 105 and the second subarray 106 in the antenna array in this embodiment. Beam direction angles of directivity patterns of the first subarray 105 at the low frequency, the center frequency, and the high frequency are 18.3 degrees, 22.1 degrees, and 24.4 degrees, and beam direction angles of directivity patterns of the second subarray 106 at the low frequency, the center frequency, and the high frequency are 24.3 degrees, 21.4 degrees, and 20.6 degrees. Therefore, there is a relatively large difference between beam direction angles of directivity patterns of each of the two subarrays at the low frequency, the center frequency, and the high frequency. In addition, it can be learned that the beam direction angle of the directivity pattern of the first subarray 105 increases with the frequency, and the beam direction angle of the directivity pattern of the second subarray 106 decreases with the frequency. FIG. 19 shows directivity pattern curves of the entire array at a low frequency, a center frequency, and a high frequency. Beam direction angles of directivity patterns of the entire array at the low frequency, the center frequency, and the high frequency are 22.4 degrees, 22.0 degrees, and 21.4 degrees. It can be learned that there is a much smaller difference between the beam direction angles of the directivity patterns of the entire array in comparison with those of the subarrays. A reason for achieving the foregoing effect is that a trend in which the beam direction angle of the directivity pattern of the first subarray 105 changes with the frequency is contrary to a trend in which the beam direction angle of the directivity pattern of the second subarray 106 changes with the frequency, so that the directivity pattern obtained through combination basically remains unchanged because of partial cancellation.

In comparison with the prior art, in this embodiment, the antenna waveguide port is disposed in the middle of the array, so that the array is divided into the two subarrays, and the location of the waveguide port and the directions in which the radiation slots in the two subarrays deviate from the center line of the waveguide are adjusted, so that a beam of the directivity pattern at the center frequency of the operating frequency band points to a required angle. In addition, a trend in which a beam direction angle of a directivity pattern of one subarray changes with the frequency is contrary to a trend in which a beam direction angle of a directivity pattern of the other subarray changes with the frequency. In this way, the beam direction angle of the directivity pattern obtained by combining the two subarrays basically remains unchanged with the frequency, thereby resolving a prior-art problem that a beam direction of a directivity pattern changes with a frequency.

It can be seen from the foregoing embodiments that in this application, on the basis of a conventional waveguide traveling wave antenna array, the feeding port is disposed in the middle of the array, so that the entire array is divided into the two subarrays, and different element spacings (first embodiment), different heights of the ridges of the feeding waveguide (second embodiment), or different directions in which elements deviate from the center line of the waveguide (third embodiment) are set for the two subarrays, so that a phase difference between units in one subarray increases with the frequency, a beam direction angle of the subarray increases with the frequency, a phase difference between units in the other subarray decreases with the frequency, and a beam direction angle of the subarray decreases with the frequency. Therefore, the beam direction angle of the entire array that is obtained through combination basically remains unchanged with the frequency because trends in which the beam direction angles of the two subarrays change with the frequency are contrary.

This application further provides a communications device. The communications device includes a baseband precoder, a transceiver channel connected to the baseband precoder, and any antenna array that is described above and that is connected to the transceiver channel.

Figure 20:
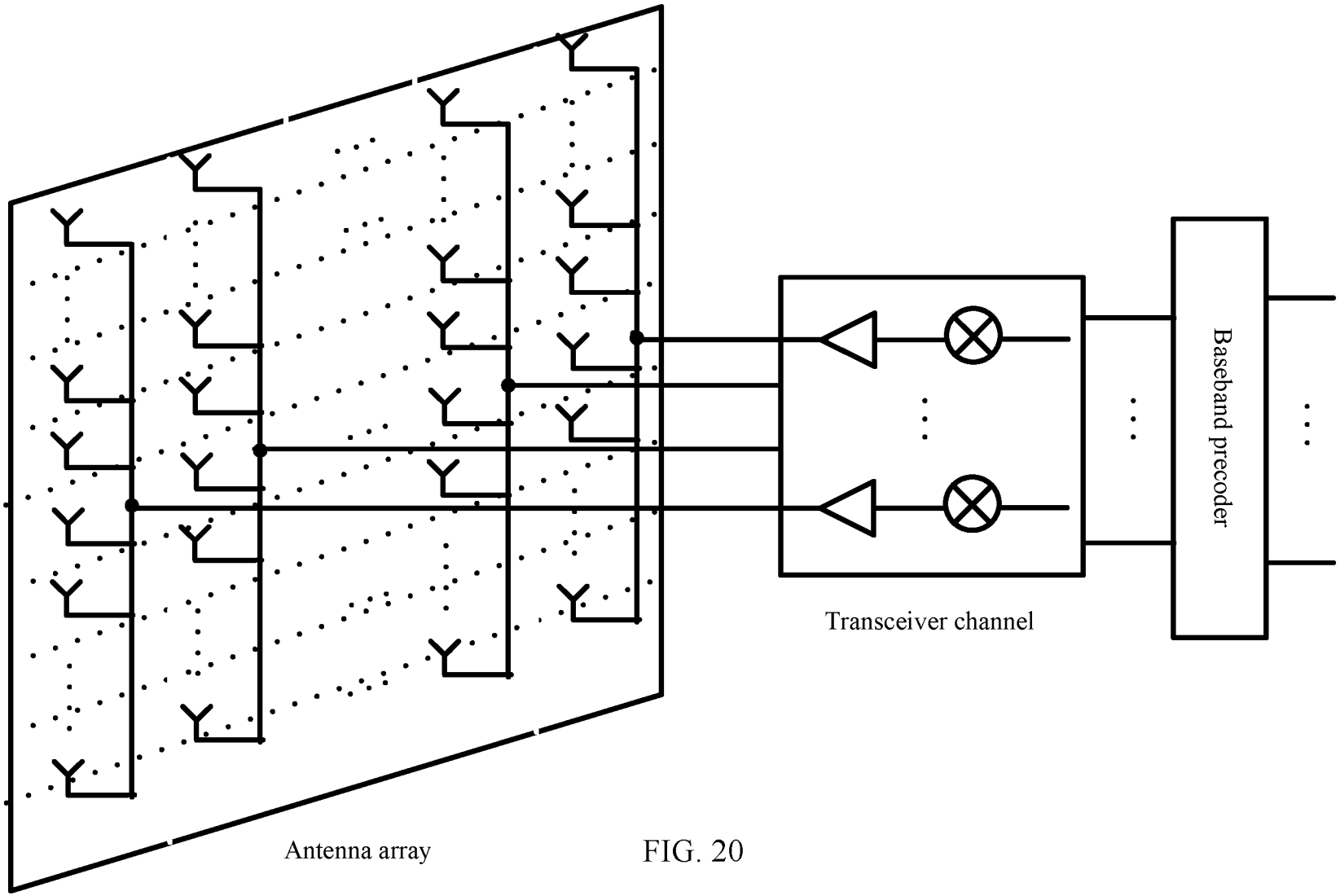
FIG. 20 is a schematic block diagram of a communications device according to an embodiment of this application.

Specifically, the antenna array disclosed in this application is applied to an AAU (active antenna unit) module in a 5G wireless communications millimeter-wave band base station system. A system architecture is shown in FIG. 20. For an antenna array part, several rows and columns of antenna array elements form a rectangular array. In a vertical direction, one column is corresponding to one antenna port, and is connected to one radio frequency transceiver channel. In a horizontal direction, a plurality of columns are connected to a plurality of radio frequency transceiver channels. In the vertical direction of the array, a single beam is formed through fixed analog weighting in an antenna feeding network, and in the horizontal direction of the array, a plurality of beams are formed by flexibly controlling amplitude and a phase by using the radio frequency channel or a baseband. In this way, radio signal coverage quality can be improved and a network capacity can be increased.

Obviously, a person skilled in the art can make various modifications and variations to the present invention without departing from the spirit and scope of the present invention. The present invention is intended to cover these modifications and variations provided that they fall within the scope of protection defined by the following claims and their equivalent technologies.

What is claimed is:

1. An antenna array, comprising a feeding waveguide and a cover that covers the feeding waveguide, wherein a waveguide port is disposed on the feeding waveguide, a plurality of radiation slots that are arranged in a length direction of the feeding waveguide and that are configured to transmit signals fed in from the waveguide port are disposed on the cover, a plurality of radiation slots on one side of the waveguide port form a first subarray, and a plurality of radiation slots on the other side of the input waveguide form a second subarray, wherein at a center frequency of an operating frequency of the antenna array, a difference between a beam direction angle of the first subarray and a beam direction angle required by the antenna array and a difference between a beam direction angle of the second subarray and the beam direction angle required by the antenna array each are less than a specified threshold, and with a change of a frequency of the antenna array, a trend in which the beam direction angle of the first subarray changes with the frequency is contrary to a trend in which the beam direction angle of the second subarray changes with the frequency.

2. The antenna array according to claim 1, wherein the plurality of radiation slots are disposed along a center line of the feeding waveguide through staggering, a center-to-center spacing between adjacent radiation slots in the first subarray is s1, a center-to-center spacing between adjacent radiation slots in the second subarray is s2, s1 is greater than a half of a wavelength of the feeding waveguide, and s2 is less than a half of the wavelength of the feeding waveguide.

3. The antenna array according to claim 2, wherein the plurality of radiation slots in the first subarray are evenly spaced, and the plurality of radiation slots in the second subarray are evenly spaced.

4. The antenna array according to claim 2, wherein in the first subarray, a spacing between a center of a radiation slot close to the waveguide port and the waveguide port is t1, in the second subarray, a spacing between a center of a radiation slot close to the waveguide port and the waveguide port is t2, and both t1 and t2 are less than a half of the wavelength of the feeding waveguide.

5. The antenna array according to claim 4, wherein the feeding waveguide is a double-ridge waveguide, the waveguide port is located between two ridges of the double-ridge waveguide, and each of the two ridges is corresponding to one subarray.

6. The antenna array according to claim 1, wherein the plurality of radiation slots are disposed along a center line of the feeding waveguide through staggering, a center-to-center spacing between adjacent radiation slots in the first subarray and a center-to-center spacing between adjacent radiation slots in the second subarray each are s3, and s3 is greater than a half of a wavelength of the feeding waveguide, wherein the feeding waveguide is a double-ridge waveguide, the waveguide port is located between two ridges of the double-ridge waveguide, each of the two ridges is corresponding to one subarray, and a height of a ridge corresponding to the first subarray is greater than a height of a ridge corresponding to the second subarray.

7. The antenna array according to claim 6, wherein in the first subarray, a spacing between a center of a radiation slot close to the waveguide port and the waveguide port is t1, in the second subarray, a spacing between a center of a radiation slot close to the waveguide port and the waveguide port is t2, t1 is greater than t2, and both t1 and t2 are less than a half of the wavelength of the feeding waveguide.

8. The antenna array according to claim 1, wherein the plurality of radiation slots in the first subarray are located on a same side of a center line of the feeding waveguide, the plurality of radiation slots in the second subarray are disposed along the center line of the feeding waveguide through staggering, a center-to-center spacing between adjacent radiation slots in the first subarray and a center-to-center spacing between adjacent radiation slots in the second subarray each are s4, and s4 is less than a half of a wavelength of the feeding waveguide.

9. The antenna array according to claim 8, wherein in the first subarray, a spacing between a center of a radiation slot close to the waveguide port and the waveguide port is t1, in the second subarray, a spacing between a center of a radiation slot close to the waveguide port and the waveguide port is t2, t1 is greater than t2, and both t1 and t2 are less than a half of the wavelength of the feeding waveguide.

10. The antenna array according to claim 9, wherein s4 is a quarter of a waveguide wavelength of the feeding waveguide at the center frequency of the operating frequency band.

11. The antenna array according to claim 5, wherein for each radiation slot, a branch corresponding to the radiation slot is disposed on a sidewall of the feeding waveguide, a gap corresponding to the branch is disposed on the ridge of the feeding waveguide, the radiation slot is located on one side of the center line of the feeding waveguide, and the branch and the gap are located on the other side of the center line of the feeding waveguide.

12. The antenna array according to claim 7, wherein for each radiation slot, a branch corresponding to the radiation slot is disposed on a sidewall of the feeding waveguide, a gap corresponding to the branch is disposed on the ridge of the feeding waveguide, the radiation slot is located on one side of the center line of the feeding waveguide, and the branch and the gap are located on the other side of the center line of the feeding waveguide.

13. The antenna array according to claim 10, wherein for each radiation slot, a branch corresponding to the radiation slot is disposed on a sidewall of the feeding waveguide, a gap corresponding to the branch is disposed on the ridge of the feeding waveguide, the radiation slot is located on one side of the center line of the feeding waveguide, and the branch and the gap are located on the other side of the center line of the feeding waveguide.

14. A communications device, comprising a baseband precoder, a transceiver channel connected to the baseband precoder, and an antenna array connected to the transceiver channel, comprising a feeding waveguide and a cover that covers the feeding waveguide, wherein a waveguide port is disposed on the feeding waveguide, a plurality of radiation slots that are arranged in a length direction of the feeding waveguide and that are configured to transmit signals fed in from the waveguide port are disposed on the cover, a plurality of radiation slots on one side of the waveguide port form a first subarray, and a plurality of radiation slots on the other side of the input waveguide form a second subarray, wherein at a center frequency of an operating frequency of the antenna array, a difference between a beam direction angle of the first subarray and a beam direction angle required by the antenna array and a difference between a beam direction angle of the second subarray and the beam direction angle required by the antenna array each are less than a specified threshold, and with a change of a frequency of the antenna array, a trend in which the beam direction angle of the first subarray changes with the frequency is contrary to a trend in which the beam direction angle of the second subarray changes with the frequency.

15. The communications device according to claim 14, wherein the plurality of radiation slots are disposed along a center line of the feeding waveguide through staggering, a center-to-center spacing between adjacent radiation slots in the first subarray is s1, a center-to-center spacing between adjacent radiation slots in the second subarray is s2, s1 is greater than a half of a wavelength of the feeding waveguide, and s2 is less than a half of the wavelength of the feeding waveguide.

16. The communications device according to claim 15, wherein the plurality of radiation slots in the first subarray are evenly spaced, and the plurality of radiation slots in the second subarray are evenly spaced.

17. The communications device according to claim 15, wherein in the first subarray, a spacing between a center of a radiation slot close to the waveguide port and the waveguide port is t1, in the second subarray, a spacing between a center of a radiation slot close to the waveguide port and the waveguide port is t2, and both t1 and t2 are less than a half of the wavelength of the feeding waveguide.

18. The communications device according to claim 17, wherein the feeding waveguide is a double-ridge waveguide, the waveguide port is located between two ridges of the double-ridge waveguide, and each of the two ridges is corresponding to one subarray.

19. The communications device according to claim 14, wherein in the first subarray, a spacing between a center of a radiation slot close to the waveguide port and the waveguide port is t1, in the second subarray, a spacing between a center of a radiation slot close to the waveguide port and the waveguide port is t2, t1 is greater than t2, and both t1 and t2 are less than a half of the wavelength of the feeding waveguide.

20. The communications device according to claim 14, wherein s4 is a quarter of a waveguide wavelength of the feeding waveguide at the center frequency of the operating frequency band.

* * * * *